US010720736B2

(12) United States Patent
Yamanashi

(10) Patent No.: US 10,720,736 B2
(45) Date of Patent: Jul. 21, 2020

(54) CONNECTOR AND ELECTRIC WIRE WITH CONNECTOR

(71) Applicant: Yazaki Corporation, Tokyo (JP)

(72) Inventor: Daisuke Yamanashi, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/223,478

(22) Filed: Dec. 18, 2018

(65) Prior Publication Data

US 2019/0190211 A1 Jun. 20, 2019

(30) Foreign Application Priority Data

Dec. 20, 2017 (JP) ..... 2017-243325

(51) Int. Cl.
*H01R 13/6592* (2011.01)
*H01R 13/41* (2006.01)
*H01R 13/502* (2006.01)

(52) U.S. Cl.
CPC ..... *H01R 13/6592* (2013.01); *H01R 13/41* (2013.01); *H01R 13/502* (2013.01)

(58) Field of Classification Search
CPC .. H01R 13/6592; H01R 13/41; H01R 13/502; H01R 13/6593; H01R 13/74; H01R 13/506; H01R 13/52
USPC ..... 439/607.41
See application file for complete search history.

(56) References Cited

U.S. PATENT DOCUMENTS 5,222,909 A * 6/1993 Nomura ..... H01R 13/6582 439/271
7,530,848 B2 * 5/2009 Nagashima ..... H01R 13/648 439/607.41
8,485,844 B2 * 7/2013 Omae ..... H01R 13/5202 439/559
8,840,428 B2 * 9/2014 Omae ..... H01R 13/506 439/582
8,956,192 B2 * 2/2015 Eckel ..... H01R 13/44 439/686
9,033,734 B2 * 5/2015 Tanaka ..... H01R 9/032 439/587

(Continued)

FOREIGN PATENT DOCUMENTS

JP 2011034880 A 2/2011
JP 2016192316 A 11/2016
JP 2017-004863 A 1/2017

*Primary Examiner* — Peter G Leigh
(74) *Attorney, Agent, or Firm* — Sughrue Mion, PLLC

(57) ABSTRACT

A connector includes a terminal fitting, an insulating housing, and a conductive shield shell. The terminal fitting includes an electrical connecting part electrically connected to a mating terminal of a mating connector and an electric wire connecting part electrically connected to a terminal of an electric wire. The housing accommodates the electrical connecting part in an inward accommodation space and causes the electric wire connecting part to protrude outward. The shield shell accommodates a space from the housing to the terminal of the electric wire inward and covers the space from outside. The shield shell includes a main shield that covers the housing from outside and a tubular sub-shield that covers the electric wire connecting part and the terminal of the electric wire from outside and is provided for each of the terminal fitting.

7 Claims, 21 Drawing Sheets

(56) References Cited

U.S. PATENT DOCUMENTS

| | | | | |
|---|---|---|---|---|
| 9,039,463 | B2 * | 5/2015 | Yamashita | H01R 13/6315 439/449 |
| 9,059,534 | B2 * | 6/2015 | Endo | H01R 13/52 |
| 9,083,107 | B2 * | 7/2015 | Suzuki | H01R 13/5219 |
| 9,124,024 | B2 * | 9/2015 | Itsuki | H01R 13/533 |
| 9,209,582 | B2 * | 12/2015 | Kashiwada | H01R 13/6315 |
| 9,318,849 | B2 * | 4/2016 | Kobayashi | H01R 13/5205 |
| 9,368,902 | B2 * | 6/2016 | Nakai | H01R 13/5202 |
| 9,455,523 | B1 * | 9/2016 | Sundarakrishnamachari | H01R 13/62927 |
| 9,620,899 | B2 * | 4/2017 | Kato | H01R 13/631 |
| 2005/0282438 | A1 * | 12/2005 | Wada | H01R 9/032 174/359 |
| 2009/0035993 | A1 * | 2/2009 | Okayasu | H01R 4/185 439/607.41 |

* cited by examiner

CONNECTOR AND ELECTRIC WIRE WITH CONNECTOR

CROSS-REFERENCE TO RELATED APPLICATION(S)

The present application claims priority to and incorporates by reference the entire contents of Japanese Patent Application No. 2017-243325 filed in Japan on Dec. 20, 2017.

BACKGROUND OF THE INVENTION

1. Field of the Invention

The present invention relates to a connector and an electric wire with the connector.

2. Description of the Related Art

Conventional connectors include terminal fittings and an insulating housing that accommodates the terminal fittings. The housing is fitted into a casing of a mating connector, thereby electrically connecting the terminal fittings to mating terminal fittings of the mating connector. This kind of connector is disclosed in Japanese Patent Application Laid-open No. 2017-004863, for example. To suppress intrusion of noise to terminal fittings and electric wires, the connector disclosed in Japanese Patent Application Laid-open No. 2017-004863 has the following structure: a plurality of terminal fittings are covered with one shield shell together with a housing, and electric wires for the respective terminal fittings are bundled and covered with one braid.

To provide a connector as a shield connector, it is necessary to secure a desired insulation distance (a clearance and a creepage distance) between a conductive electrical connection part (a part, such as a terminal fitting, for electrical connection to a mating component) and a shield member (conductive member for noise reduction, such as a shield shell).

SUMMARY OF THE INVENTION

The present invention aims to provide a connector and an electric wire with the connector that can secure a desired insulation distance between an electrical connection part and a shield member.

A connector according to one aspect of the present invention includes a terminal fitting including an electrical connecting part that is electrically connected to a mating terminal of a mating connector and an electric wire connecting part that is electrically connected to a terminal of an electric wire; an insulating housing that accommodates the electrical connecting part in an inward accommodation space and causes the electric wire connecting part to protrude outward; and a conductive shield shell that accommodates a space from the housing to the terminal of the electric wire inward and covers the space from outside, wherein the shield shell includes a main shield that covers the housing from outside and a tubular sub-shield that covers the electric wire connecting part and the terminal of the electric wire from outside and is provided for each of the terminal fitting, and an insulating tubular member that covers the electric wire connecting part and the terminal of the electric wire from outside is provided inward in the sub-shield.

According to another aspect of the present invention, in the connector, it is preferable that the housing has an insertion hole through which the terminal fitting is inserted into the accommodation space from a distal end on a side of the electrical connecting part together with a first end of the tubular member in a first tube axial direction of the tubular member.

According to still another aspect of the present invention, in the connector, it is preferable that the housing includes a first housing member that has a tubular shape with an opening at at least one end in a second tube axial direction and that accommodates the electrical connecting part in the inward accommodation space and a second housing member that is accommodated in the accommodation space along the second tube axial direction from the opening of the first housing member, an outer peripheral wall of the first housing member has the insertion hole, and the second housing member has a terminal housing chamber that accommodates the electrical connecting part in the accommodation space, a terminal holding part that holds a held part of the terminal fitting so as to prevent the electrical connecting part from coming off the terminal housing chamber, and a locking part that locks a locked part provided at the first end of the tubular member in the first tube axial direction of the tubular member to prevent a movement of the tubular member with respect to the housing in the first tube axial direction of the tubular member.

According to still another aspect of the present invention, in the connector, it is preferable that a second shield member that is electrically connected to the shield shell serving as a first shield member is provided for each of the terminal fitting, and the second shield member has a tubular shape so as to cover, from outside, an end of the sub-shield on a side of an opening and the electric wire led out from the opening of the sub-shield.

An electric wire with a connector according to still another aspect of the present invention includes an electric wire; a terminal fitting including an electrical connecting part that is electrically connected to a mating terminal of a mating connector and an electric wire connecting part that is electrically connected to a terminal of the electric wire; an insulating housing that accommodates the electrical connecting part in an inward accommodation space and causes the electric wire connecting part to protrude outward; and a conductive shield shell that accommodates a space from the housing to the terminal of the electric wire inward and covers the space from outside, wherein the shield shell includes a main shield that covers the housing from outside and a tubular sub-shield that covers the electric wire connecting part and the terminal of the electric wire from outside and is provided for each of the terminal fitting, and an insulating tubular member that covers the electric wire connecting part and the terminal of the electric wire from outside is provided inward in the sub-shield.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
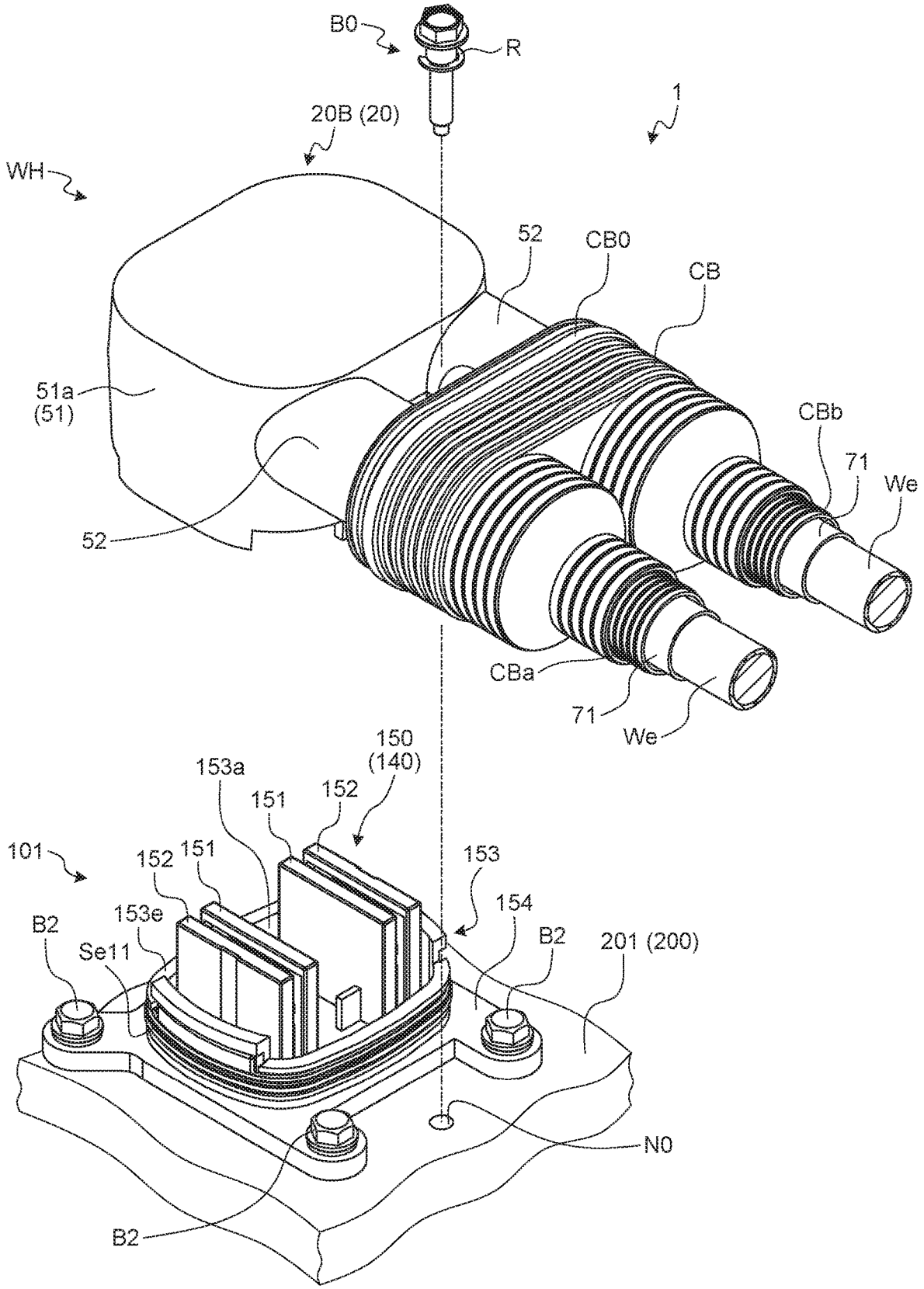
FIG. 1 is a perspective view of a connector and an electric wire with the connector according to an embodiment of the present invention and a mating connector in a state where the connector is yet to be fitted into the mating connector.

Exemplary embodiments of a connector and an electric wire with the connector according to the present invention are described below in greater detail with reference to the accompanying drawings. The embodiments are not intended to limit the present invention.

EMBODIMENTS

One of the embodiments of the connector and the electric wire with the connector according to the present invention is described with reference to FIGS. 1 to 24.

A reference numeral 1 in FIGS. 1 to 4 denotes a connector according to the present embodiment. A reference letter WH in FIGS. 1 to 4 denotes an electric wire with the connector in which the connector 1 is attached to electric wires We in a manner being electrically connected thereto.

The connector 1 and a mating connector 101 (FIG. 1) constitute a connector device. The connector device physically and electrically connects a first connector and a second connector, thereby electrically coupling respective connection objects electrically connected to the first connector and the second connector. In the present specification, the connector 1 is defined as the first connector, and the mating connector 101 is defined as the second connector for convenience.

The connection objects indicate a power supply circuit, such as an inverter, and an electrical apparatus, such as a rotator, for example. The connector 1, for example, is electrically connected to an electrical apparatus (not illustrated) via the wire We. By contrast, the mating connector 101 is attached to a casing 201 of a power supply circuit 200 (FIG. 1) and electrically connected to the power supply circuit 200 via an electric wire (not illustrated). The connector 1 and the mating connector 101 are electrically connected to each other, thereby electrically coupling the electrical apparatus and the power supply circuit 200. The connector 1 and the mating connector 101 thus enable supplying electricity from a power source (e.g., a secondary battery) to the electrical apparatus and charging electricity generated by the electrical apparatus to the power source.

The connector 1 according to the present embodiment is inserted and fitted into the mating connector 101, thereby being electrically connected to the mating connector 101. The connector 1 is extracted from the mating connector 101, thereby cutting electrical connection between the connector 1 and the mating connector 101. The insertion and fitting direction is referred to as a "connector insertion direction", and the extraction direction is referred to as a "connector extraction direction". Both of the directions are referred to as a "connector insertion and extraction direction" when they are not particularly specified. These directions indicate the directions of the connector 1 with respect to the mating connector 101 when the connector 1 is the subject of description and indicate the directions of the mating connector 101 with respect the connector 1 when the mating connector 101 is the subject of description.

The connector 1 according to the present embodiment may be a female connector including a female terminal or a male connector including a male terminal as long as it has the structure described below in greater detail. In the example described below, the connector 1 is a male connector, and the mating connector 101 is a female connector.

Figure 4:
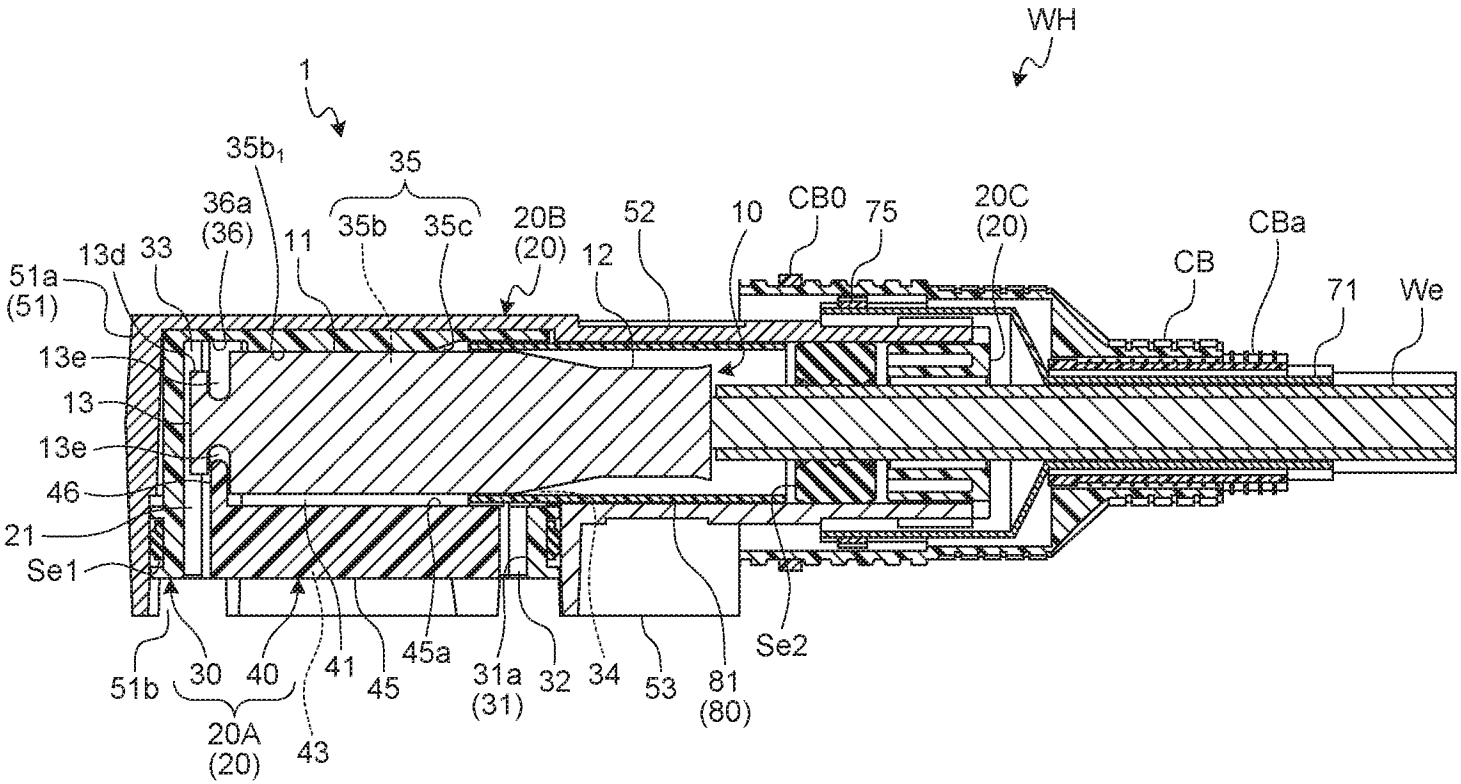
FIG. 4 is a sectional view along line X1-X1 of FIG. 3.
Figure 5:
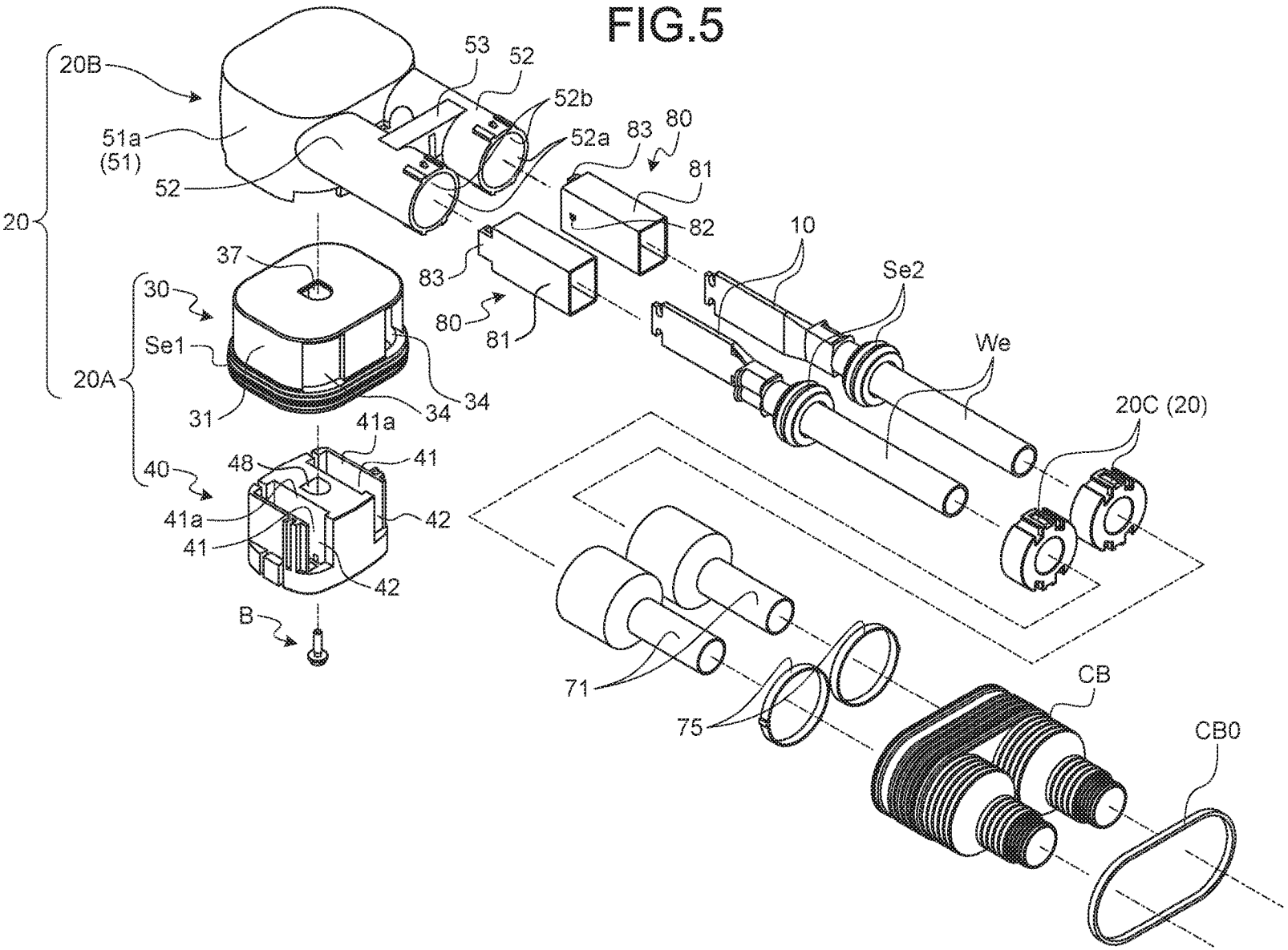
FIG. 5 is an exploded perspective view of the connector according to the embodiment and the electric wires.
Figure 6:
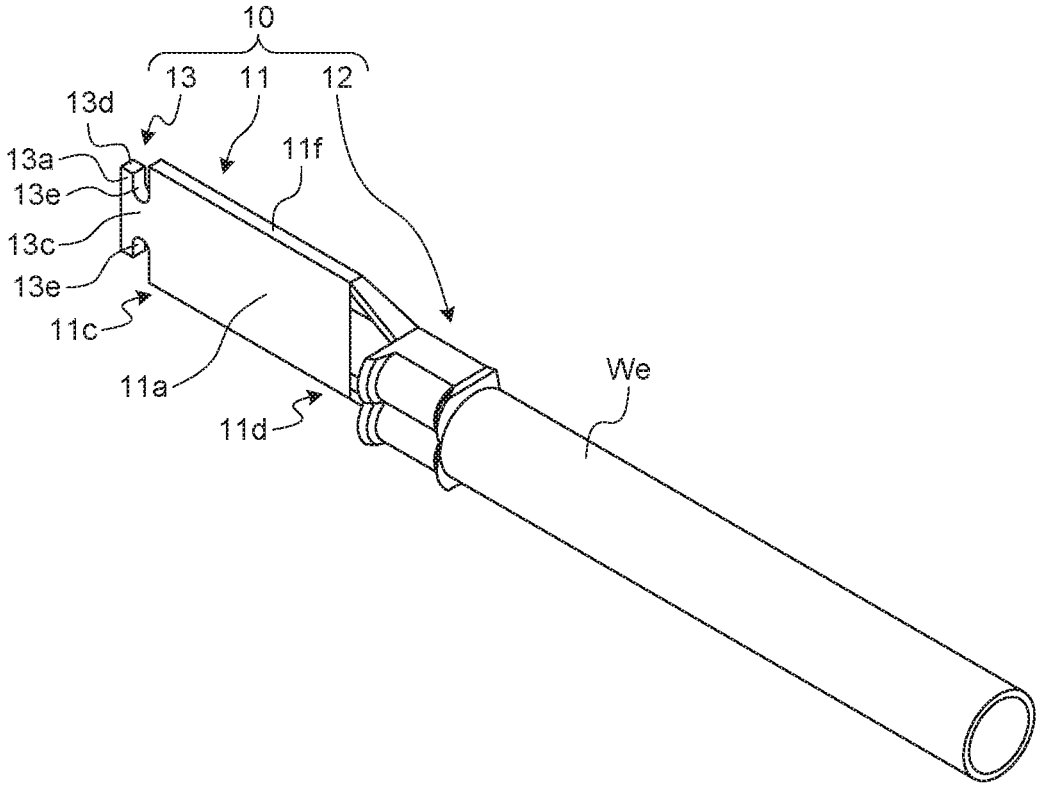
FIG. 6 is a perspective view of a terminal fitting attached to the electric wire.

The connector 1 according to the present embodiment includes terminal fittings 10 and a casing 20 (FIGS. 4 and 5).

The terminal fitting 10 according to the present embodiment is made of a conductive material, such as a metal (e.g., copper, copper alloy, aluminum, and aluminum alloy) and has a male shape. In this example, a conductive metal plate is prepared as a base material and formed into the male-shaped terminal fitting 10 by press working, such as cutting and bending. The terminal fitting 10 includes an electrical connecting part 11 and an electric wire connecting part 12 (FIGS. 4 and 6 to 9). The electrical connecting part 11 is electrically connected to a mating terminal 110, which will be described later, of the mating connector 101. The electric wire connecting part 12 is electrically connected to a terminal of the electric wire We.

Figure 9:
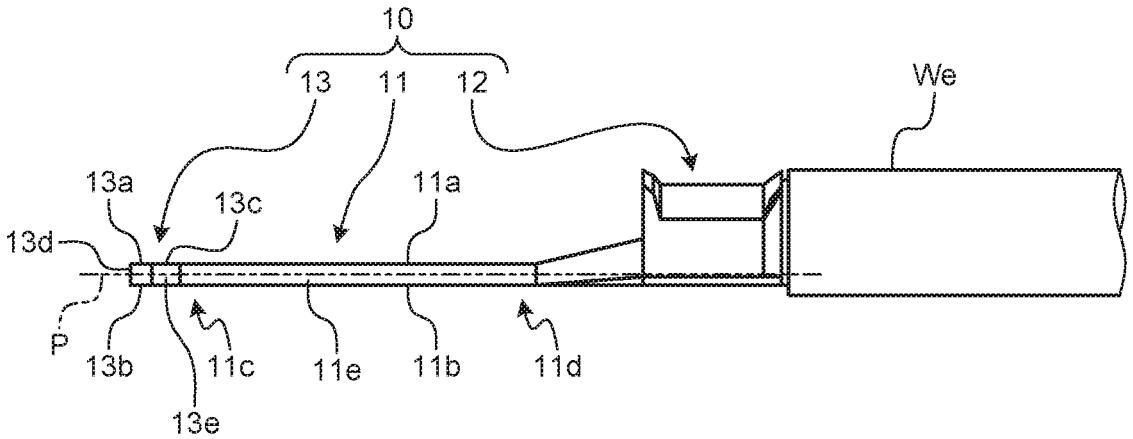
FIG. 9 is a side view of the terminal fitting attached to the electric wire viewed from the first wall surface.

The electrical connecting part 11 in this example has a male shape. The electrical connecting part 11 has a plate shape having two flat wall surfaces (a first wall surface 11*a* and a second wall surface 11*b*) (FIG. 9). The electrical connecting part 11 has a rectangular plate shape, and the first wall surface 11*a* and the second wall surface 11*b* are disposed facing each other in parallel. In the electrical connecting part 11, at least one of the first wall surface 11*a* and the second wall surface 11*b* is used as a contact part physically and electrically connected to the mating terminal 110. The mating terminal 110 includes two electrical connecting parts (a first electrical connecting part 121 and a second electrical connecting part 122), which will be described later. Consequently, the first wall surface 11*a* and the second wall surface 11*b* are used as the contact parts electrically connected to the respective electrical connecting parts.

The electric wire connecting part 12 in this example is physically and electrically connected to the terminal of the electric wire We. The electric wire connecting part 12 may be crimped to the terminal of the electric wire We by swaging or fixed thereto by welding, for example. The electric wire connecting part 12 in this example is crimped to the terminal of the electric wire We.

In the terminal fitting 10 in this example, the electrical connecting part 11 has a first end 11*c* and a second end 11*d* disposed facing each other. The first end 11*c* serves as the distal end, and the electric wire connecting part 12 is disposed at the second end 11*d* (FIGS. 6 to 9).

The terminal fitting 10 in this example has a virtual axis P (FIGS. 8 and 9) extending along an axial direction of the terminal of the electric wire We physically and electrically connected to the electric wire connecting part 12. A held part 13, which will be described later, the electrical connecting part 11, and the electric wire connecting part 12 are disposed in this order from the distal end along the virtual axis P.

Figure 8:
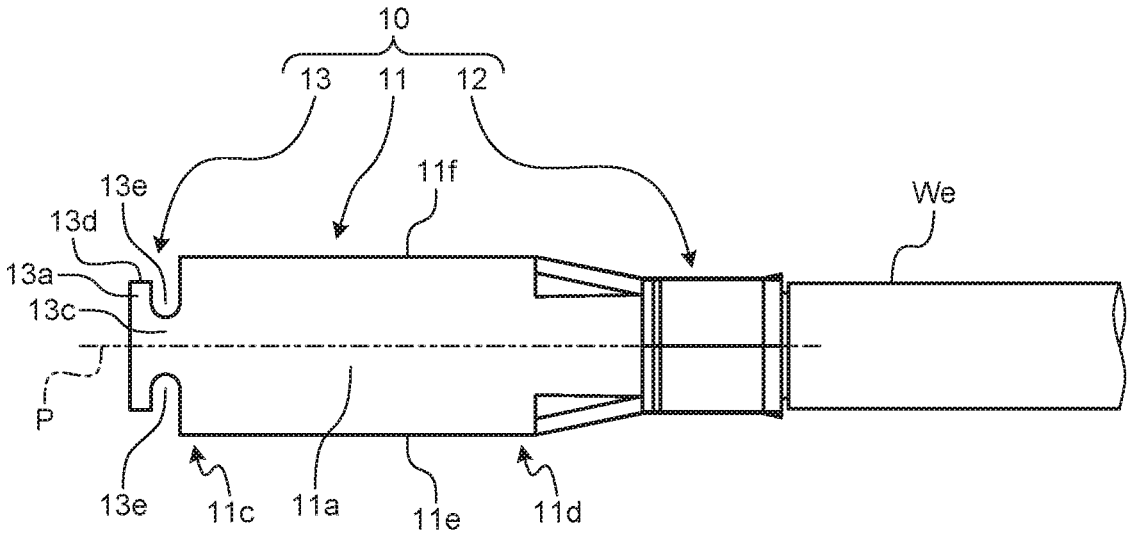
FIG. 8 is a plan view of the terminal fitting attached to the electric wire viewed from a first wall surface.

Specifically, the electrical connecting part 11 extends in a direction extending along the virtual axis P (hereinafter, simply referred to as an "axial direction"). In the electrical connecting part 11, one end in the axial direction corresponds to the first end 11*c*, and the other end in the axial direction corresponds to the second end 11*d* (FIGS. 8 and 9). The electrical connecting part 11 has two end surfaces (a first end surface 11*e* and a second end surface 11*f*) disposed facing each other in a direction different from the direction in which the two ends 11*c* and 11*d* are disposed facing each other (FIG. 8). The first end surface 11*e* and the second end surface 11*f* are disposed facing each other in parallel in a direction orthogonal to the axial direction of the terminal fitting 10 and the direction orthogonal to the first wall surface 11*a* and the second wall surface 11*b*. In the electrical connecting part 11, the first end surface 11*e* and the second end surface 11*f* are substantially rectangular plates having the same shape symmetrical with respect to the virtual axis P.

The connector 1 according to the present embodiment includes the terminal fittings 10 corresponding to the number of poles, for example. In this example, two terminal fittings 10 are provided (FIG. 5). While the connector 1 includes a plurality of the same terminal fittings 10 in the casing 20, the terminal fittings 10 in this example may include terminal fittings having different shapes.

The following describes the casing 20 according to the present embodiment.

The casing 20 according to the present embodiment includes a housing 20A that accommodates the terminal fittings 10 (FIGS. 2 to 5 and 10). The casing 20 according to the present embodiment also includes a shield shell 20B that accommodates the components from the housing 20A to the terminals of the electric wires We and covers them from outside (FIGS. 1 to 5). The casing 20 according to the present embodiment also includes holding members 20C that prevent the terminal fittings 10 from coming off the housing 20A on the electric wire We side (FIGS. 4 to 5).

The following describes the housing 20A.

The housing 20A is made of an insulating material, such as a synthetic resin. The housing 20A accommodates the electrical connecting part 11 in an accommodation space 33, which will be described later, and causes the electric wire connecting parts 12 to protrude outward. The housing 20A according to the present embodiment mainly includes a first housing member 30 and a second housing member 40 (FIGS. 2 to 5 and 10).

The first housing member 30 has a tubular shape opened at at least one end in the tube axial direction. The first housing member 30 has a tube-like outer peripheral wall 31 (FIGS. 3 to 5 and 10). The first housing member 30 in this example has the outer peripheral wall 31 having a rectangular tubular shape. A first end of the first housing member 30 in the tube axial direction is opened, and a second end thereof is closed. In the first housing member 30, the mating terminal 110 is inserted into the accommodation space 33 (FIGS. 2 and 10) along the tube axial direction from an opening 32 (FIGS. 2, 4, and 10) at the first end. More specifically, the mating terminal 110 is inserted into the accommodation space 33 from the opening 32 through the second housing member 40, which will be described later.

Figure 10:
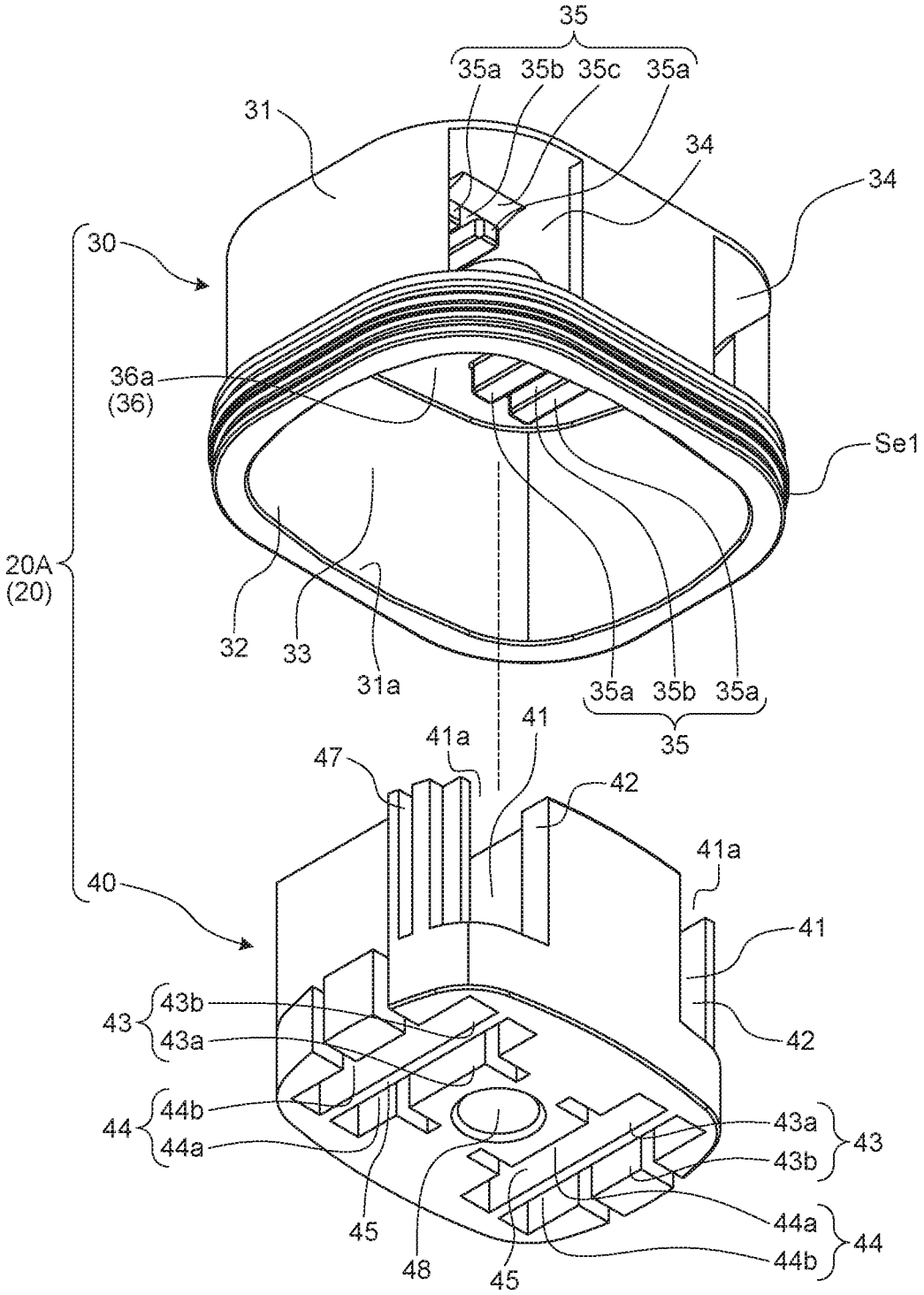
FIG. 10 is an exploded perspective view of a housing.

The end of the outer peripheral wall 31 on the opening 32 side serves as a fitting part (connector fitting part) 31*a* fitted with a connector fitting part 153*e*, which will be described later, of the mating connector 101 (FIGS. 4 and 10). The connector fitting part 153*e* is inserted and fitted into the connector fitting part 31*a*. An annular seal member Se1 is coaxially attached to the outer peripheral surface of the connector fitting part 31*a* (FIGS. 4, 5, and 10).

The outer peripheral wall 31 has insertion holes 34 through which the terminal fitting 10 is inserted into the accommodation space 33 from the distal end of the electrical connecting part 11 (FIGS. 5 and 10). The first housing member 30 in this example accommodates the electrical connecting part 11 in the accommodation space 33 and causes the electric wire connecting part 12 to protrude outward from the insertion hole 34 (FIG. 4).

The insertion holes 34 are formed for the respective terminal fittings 10. The outer peripheral wall 31 in this example has two insertion holes 34 (FIGS. 5 and 10). The insertion holes 34 are formed and disposed such that the respective terminal fittings 10 are inserted thereinto with their axial directions extending in the same direction. In other words, the axial direction of the terminal fitting 10 corresponds to an insertion direction (hereinafter, referred to as a "terminal insertion direction") of the terminal fitting 10 into the accommodation space 33. The insertion holes 34 are formed and disposed such that the respective terminal fittings 10 are inserted thereinto with the first end surface 11*e* and the second end surface 11*f* of the electrical connecting part 11 facing the tube axial direction of the outer peripheral wall 31 (that is, with the first wall surface 11*a* and the second wall surface 11*b* of the electrical connecting part 11 extending along the tube axial direction of the outer peripheral wall 31).

The first housing member 30 in this example includes a guide part 35 that guides insertion of the terminal fitting 10 into the accommodation space 33 through the insertion hole 34 (FIGS. 4 and 10). The insertion hole 34, for example, extends to a wall 36 at the other end of the outer peripheral wall 31 in the tube axial direction. The guide part 35 is provided on a wall surface 36*a* of the wall 36 on the accommodation space 33 side. The guide parts 35 are provided for the respective terminal fittings 10. In this example, the guide parts 35 are provided at two positions on the wall surface 36*a*.

The guide part 35 in this example includes two protrusions 35*a* protruding in the tube axial direction of the outer peripheral wall 31 from the wall surface 36*a* and extending in the terminal insertion direction (FIG. 10). The protrusions 35*a* are disposed facing each other with a space interposed therebetween. The space is set to substantially the same size as that of the thickness of the electrical connecting part 11 within a range not preventing insertion of the electrical connecting part 11 into the accommodation space 33. The guide part 35 has a groove (hereinafter, referred to as a "guide groove") 35*b* extending along the terminal insertion direction between the protrusions 35*a* (FIGS. 4 and 10). In the terminal fitting 10, the electrical connecting part 11 is guided along the guide groove 35*b* from the first end 11*c*. By setting the space to substantially the same size as that of the thickness of the electrical connecting part 11, the guide groove 35*b* can suppress looseness of the electrical connecting part 11 between the protrusions 35*a*. A groove bottom $35b_1$ of the guide groove 35*b* in this example is made closer to the opening 32 than the wall surface 36*a* (FIG. 4).

The guide part 35 in this example also has a guide wall surface 35*c* that guides the first end 11*c* of the electrical connecting part 11 inserted from the insertion hole 34 to the guide groove 35*b* (FIGS. 4 and 10). The guide wall surface 35*c* is an inclined surface that guides the first end 11*c* of the electrical connecting part 11 from the wall surface 36*a* to the groove bottom $35b_1$ of the guide groove 35*b*.

Figure 11:
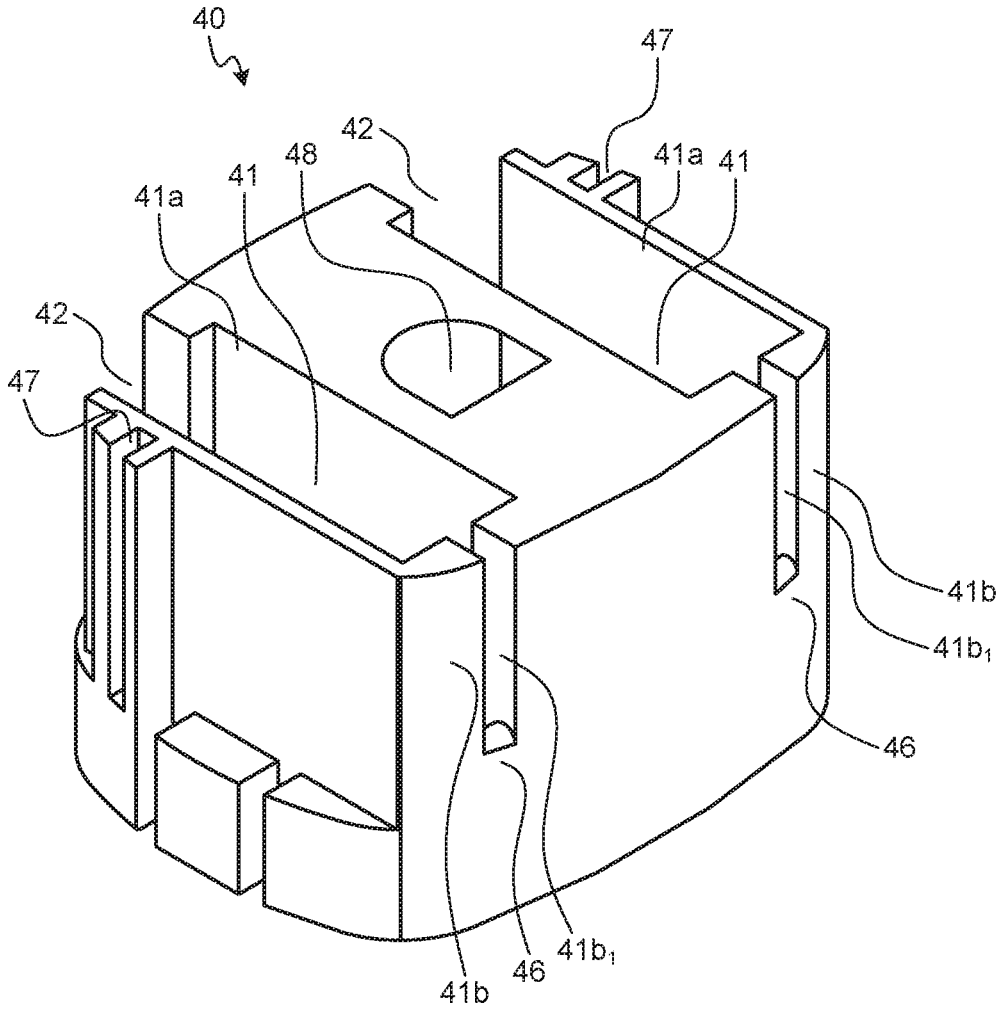
FIG. 11 is a perspective view of a second housing member viewed from another angle.

The second housing member 40 has a polyhedral shape corresponding to the shape of the accommodation space 33 of the first housing member 30 (FIGS. 10 and 11). The second housing member 40 is accommodated in the accommodation space 33 along the tube axial direction from the opening 32 of the first housing member 30 (FIGS. 2, 4, 5, and 10). The second housing member 40 accommodates the electrical connecting part 11 of the terminal fitting 10 when accommodation of the second housing member 40 in the accommodation space 33 is finished (FIG. 4).

The second housing member 40 has terminal housing chambers 41 that each accommodate the electrical connecting part 11 in the accommodation space 33 (FIGS. 4, 5, and 10 to 12). The terminal housing chamber 41 starts to accommodate the electrical connecting part 11 accommodated in the accommodation space 33 from an opening 41*a* (FIGS. 5, 10, and 11) as the second housing member 40 is inserted into the accommodation space 33. When accommodation of the second housing member 40 in the accommodation space 33 is finished, the terminal housing chamber 41 finishes accommodation of the electrical connecting part 11. The second housing member 40 has cutouts 42 that each cause the terminal housing chamber 41 to communicate with the outside on the outer peripheral surface (FIGS. 5, 10, and 11). The electric wire connecting part 12 protrudes outside the second housing member 40 from the cutout 42. The cutout 42 faces the insertion hole 34 when the second housing member 40 is accommodated in the accommodation space 33 so that the electric wire connecting part 12 can protrude outward from the insertion hole 34 of the first housing member 30.

The terminal housing chamber 41 accommodates the first electrical connecting part 121 and the second electrical connecting part 122 and two contact members 130, which will be described later, of the mating terminal 110 when fitting (hereinafter, referred to as "connector fitting") of the connector 1 and the mating connector 101 is finished. In the terminal housing chamber 41, the respective contact members 130 are brought into contact with the first wall surface 11*a* and the second wall surface 11*b* of the electrical connecting part 11, thereby physically and electrically connecting therebetween. The second housing member 40 has terminal insertion ports 43 through which the mating terminal 110 is inserted into the terminal housing chamber 41 (FIGS. 2, 3, 10, and 12). The terminal insertion port 43 is formed in a manner disposed on the opening 32 side of the first housing member 30 when the second housing member 40 is accommodated in the accommodation space 33. The terminal insertion port 43 faces the terminal housing chamber 41 in the tube axial direction of the outer peripheral wall 31. Consequently, the terminal insertion port 43 faces one of the first end surface 11*e* and the second end surface 11*f* of the electrical connecting part 11 accommodated in the accommodation space 33.

The second housing member 40 has communication chambers 44 that each cause the terminal housing chamber 41 to communicate with the terminal insertion port 43 in the tube axial direction of the outer peripheral wall 31 (FIGS. 2, 3, 10, and 12). Consequently, one of the first end surface 11*e* and the second end surface 11*f* of the electrical connecting part 11 is disposed facing the terminal insertion port 43 through the communication chamber 44 when the electrical connecting part 11 is accommodated in the terminal housing chamber 41.

The second housing member 40 has contact prevention parts 45 that each stop fingers of an operator and other persons to prevent the fingers from coming into contact with the electrical connecting part 11 through the terminal insertion port 43 (FIGS. 2 to 4 and 10 to 12). The contact prevention part 45 is formed and disposed such that fingers do not reach the electrical connecting part 11 through the terminal insertion port 43. The contact prevention part 45, for example, is disposed covering at least part of the end surface (the first end surface 11*e* or the second end surface 11*f*) of the electrical connecting part 11 disposed facing the terminal insertion port 43 from the terminal insertion port 43 side in the tube axial direction of the outer peripheral wall 31. The contact prevention part 45 is provided in the communication chamber 44 in a manner not preventing insertion of the mating terminal 110 into the terminal housing chamber 41.

The contact prevention part 45 in this example has a plate shape having two flat wall surfaces. The contact prevention part 45 is formed in the communication chamber 44 with the two wall surfaces extending along the tube axial direction of the outer peripheral wall 31. The contact prevention part 45 in this example has a rectangular plate shape. The contact prevention part 45 is disposed in a manner dividing the communication chamber 44 into two chambers in the direction orthogonal to the first wall surface 11*a* and the second wall surface 11*b* of the electrical connecting part 11. In other words, the communication chamber 44 is divided into a first division communication chamber 44*a* and a second division communication chamber 44*b* by the contact prevention part 45 in the orthogonal direction (FIGS. 2, 3, 10, and 12). The terminal insertion port 43 is also divided into a first division insertion port 43*a* and a second division insertion port 43*b* by the contact prevention part 45 in the orthogonal direction (FIGS. 2, 3, 10, and 12). The first electrical connecting part 121, which will be described later, of the mating terminal 110 is inserted into the terminal housing chamber 41 through the first division insertion port 43*a* and the first division communication chamber 44*a*. The second electrical connecting part 122, which will be described later, of the mating terminal 110 is inserted into the terminal housing chamber 41 through the second division insertion port 43*b* and the second division communication chamber 44*b*.

In this example, a combination of the first electrical connecting part 121, which is one of a pair, and one of the contact members 130 and a first housing 151, which will be described later, are inserted into the first division communication chamber 44*a* from the first division insertion port 43*a* and then inserted into the terminal housing chamber 41. In the terminal housing chamber 41, one of the contact members 130 comes into contact with the first wall surface 11*a* of the electrical connecting part 11, thereby electrically connecting the electrical connecting part 11 to the first electrical connecting part 121. In this example, a combination of the second electrical connecting part 122, which is the other of the pair, and the other of the contact members 130 and a second housing 152, which will be described later, are inserted into the second division communication chamber 44*b* from the second division insertion port 43*b* and then inserted into the terminal housing chamber 41. In the terminal housing chamber 41, the other of the contact members 130 comes into contact with the second wall surface 11*b* of the electrical connecting part 11, thereby electrically connecting the electrical connecting part 11 to the second electrical connecting part 122. In the second housing member 40, the first division insertion port 43*a*, the second division insertion port 43*b*, the first division communication chamber 44*a*, the second division communication chamber 44*b*, and the contact prevention part 45 are formed and disposed such that the insertion described above can be carried out.

The second housing member 40 has terminal holding parts 46 that each hold the held part 13 (FIGS. 3, 4, and 6 to 9) of the terminal fitting 10 so as to prevent the electrical connecting part 11 from coming off the terminal housing chamber 41 (FIGS. 4 and 11). The terminal holding part 46 holds the held part 13, thereby preventing the electrical connecting part 11 from coming off the terminal housing chamber 41 (FIG. 4). The held part 13 and the terminal holding part 46 are formed and disposed so as to hold at least one of the distal end and the proximal end of the terminal fitting 10. In the terminal fitting 10 in this example, the electric wire connecting part 12 protrudes outside the housing 20A. The proximal end of the terminal fitting 10 at which the held part 13 is disposed indicates the end 11*d* of the electrical connecting part 11 on the electric wire connecting part 12 side. In this example, for example, the held part 13 is formed at the distal end of the terminal fitting 10 as an inserted part, and the terminal holding part 46 is formed as an insertion part inserted into the held part 13 simultaneously with insertion of the second housing member 40 into the accommodation space 33. The held part 13 and the terminal holding part 46 are formed so as to prevent a movement of the terminal fitting 10 in the terminal insertion direction with respect to the accommodation space 33 and a movement of the terminal fitting 10 in a direction opposite to the terminal insertion direction.

Figure 7:
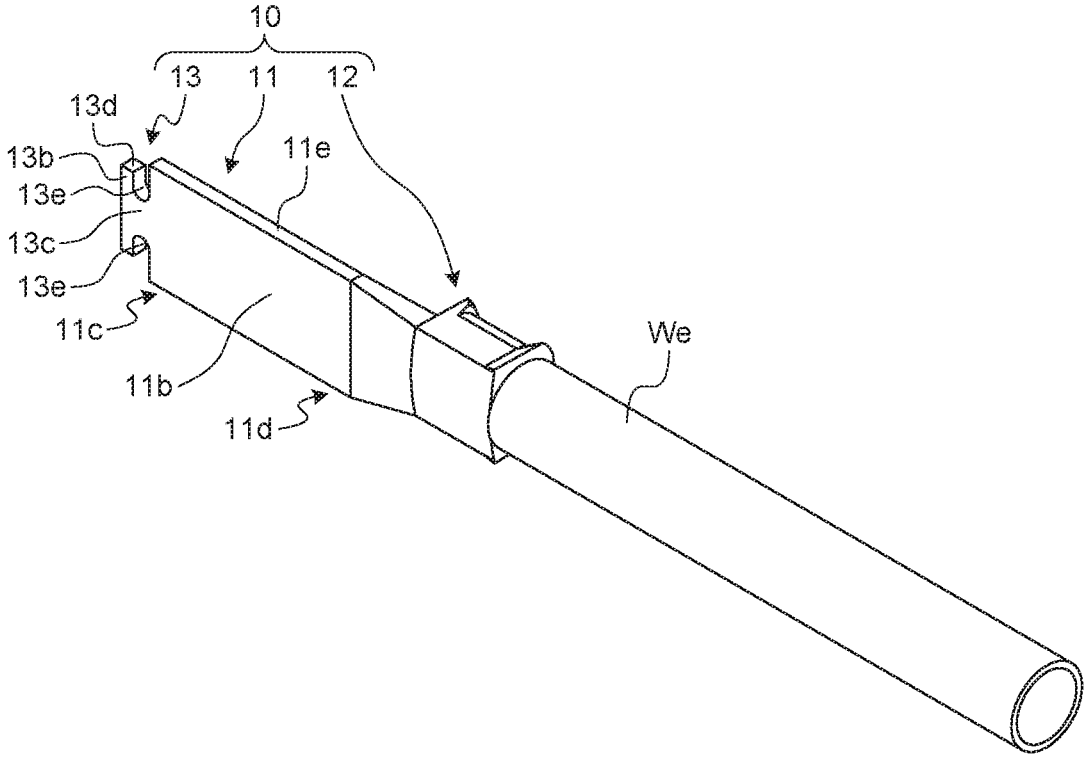
FIG. 7 is a perspective view of the terminal fitting attached to the electric wire viewed from another angle.

Specifically, the held part 13 in this example has a T-shape protruding along the virtual axis P from the distal end (first end 11*c*) of the electrical connecting part 11. The held part 13 has a T-shaped first wall surface 13*a* (FIGS. 6, 8, and 9) and a T-shaped second wall surface 13*b* (FIGS. 7 and 9). The first wall surface 13*a* extends on the same plane as that of the first wall surface 11*a* of the electrical connecting part 11. The second wall surface 13*b* extends on the same plane as that of the second wall surface 11*b* of the electrical connecting part 11. The held part 13 also has a shaft 13*c* of the T-shape and an intersection part 13*d* (FIGS. 6 to 9). The shaft 13*c* extends with its central axis aligned with the virtual axis P. The intersection part 13*d* orthogonally intersects the shaft 13*c* at the distal end of the shaft 13*c*. In the held part 13, cutout-like grooves 13*e* (FIGS. 4 and 6 to 9) formed between the held part 13 and the first end 11*c* of the electrical connecting part 11 are used as the inserted part. The grooves 13*e* are formed at two positions symmetrically with respect to the virtual axis P.

In the held part 13 in this example, both parts with respect to the virtual axis P have the same shape in a direction orthogonal to the axial direction and the direction orthogonal to the first wall surface 13*a* and the second wall surface 13*b*. Consequently, both of the grooves 13*e* of the held part 13 can be used as the inserted part. If the first end surface 11*e* of the terminal fitting 10 is disposed facing the terminal insertion port 43 in the terminal housing chamber 41, for example, one of the two grooves 13*e* is used as the inserted part. By contrast, if the second end surface 11*f* of the terminal fitting 10 is disposed facing the terminal insertion port 43 in the terminal housing chamber 41, the other of the two grooves 13*e* is used as the inserted part.

The terminal holding part 46 is inserted into the groove 13*e* of the held part 13 when the second housing member 40 is accommodated in the accommodation space 33. In this example, a wall 41*b* defining the terminal housing chamber 41 has cutout-like grooves $\mathbf{41}b_1$ cut out along the tube axial direction of the outer peripheral wall 31 (FIG. 11). In the terminal holding part 46 in this example, a remaining portion of the wall 41*b* the top of which corresponds to the bottom of the groove $\mathbf{41}b_1$ is used as the insertion part. In this example, the groove 13*e* of the held part 13 and the groove $\mathbf{41}b_1$ of the terminal holding part 46 start to engage with each other as the second housing member 40 is inserted into the accommodation space 33. In the held part 13 and the terminal holding part 46, insertion of the remaining portion of the wall 41*b* into the groove 13*e* is finished simultaneously with the finish of accommodation of the second housing member 40 into the accommodation space 33. As a result, the electrical connecting part 11 can be held while being kept in the accommodated state in the terminal housing chamber 41.

Figure 3:
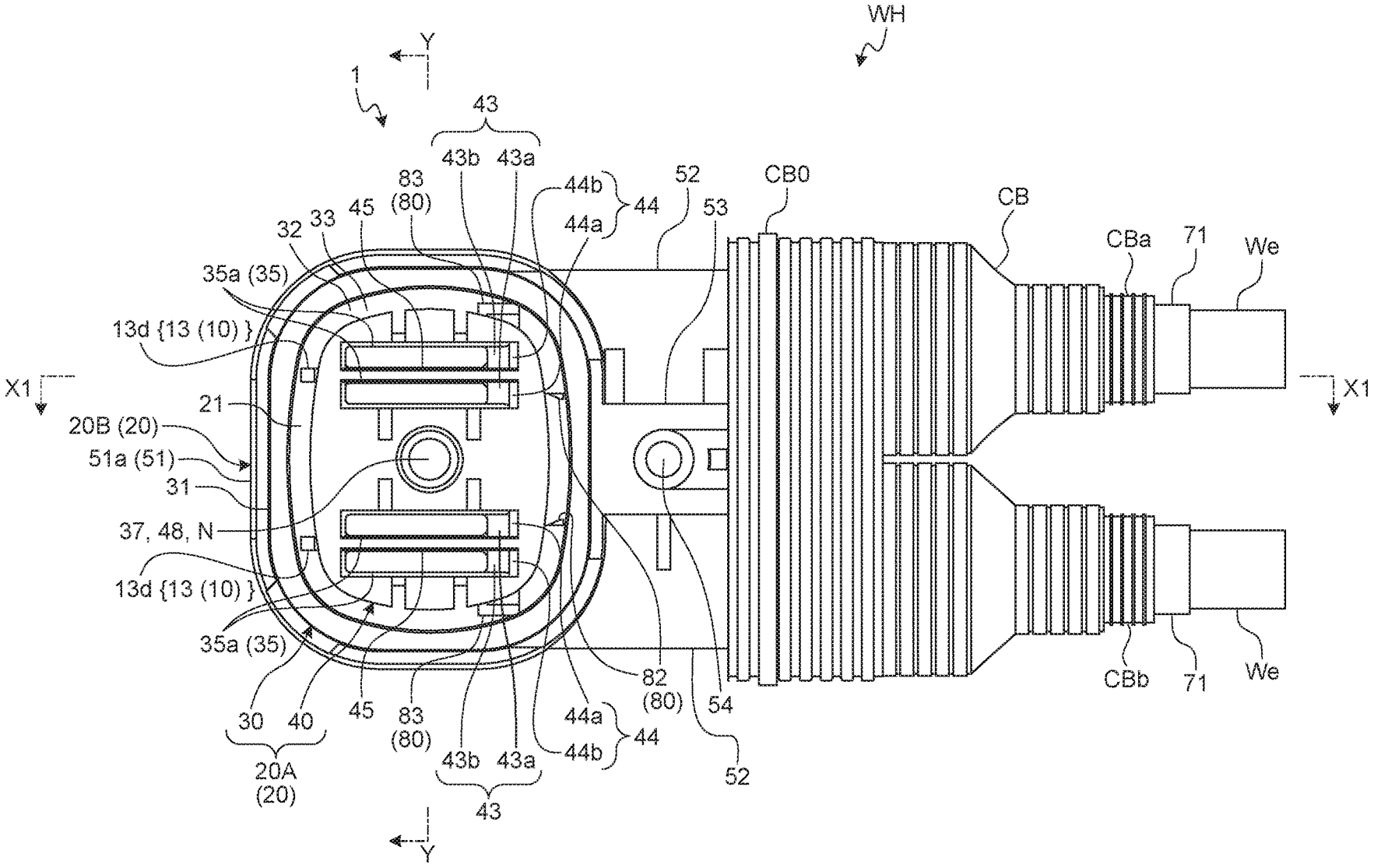
FIG. 3 is a plan view of the connector and the electric wire with the connector according to the embodiment viewed from a terminal insertion port.

In the held part 13, the intersection part 13*d* is disposed outer than the outer peripheral surface of the second housing member 40 when the remaining portion of the wall 41*b* is inserted into the groove 13*e* (FIGS. 3 and 4). The housing 20A has an annular space 21 between the inner peripheral surface of the first housing member 30 and the outer peripheral surface of the second housing member 40 (FIGS. 3 and 4). The width of the space 21 is sufficiently large to accommodate the intersection part 13*d* and sufficiently small to prevent the fingers of the operator and other persons from entering thereinto. The connector 1 enables checking electrical continuity using the intersection part 13*d* disposed in the space 21.

The guide part 35 can suppress looseness of the electrical connecting part 11 between the protrusions 35*a*. One of the first end surface 11*e* and the second end surface 11*f* of the electrical connecting part 11 is disposed facing the groove bottom $\mathbf{35}b_1$ of the guide groove 35*b* when the second housing member 40 is accommodated in the accommodation space 33. The other of the first end surface 11*e* and the second end surface 11*f* is disposed facing an end surface 45*a* (end surface on the opposite side of the terminal insertion port 43 side) of the contact prevention part 45 (FIG. 4). The first housing member 30 and the second housing member 40 may be formed to hold the electrical connecting part 11 by the groove bottom 35$b_1$ and the end surface 45*a* when accommodation of the second housing member 40 into the first housing member 30 is finished. In other words, the first housing member 30 and the second housing member 40 may be formed to sandwich and hold the electrical connecting part 11 when accommodation of the second housing member 40 into the first housing member 30 is finished. With this structure, the connector 1 can increase the effect of preventing coming-off of the electrical connecting part 11 from the terminal housing chamber 41 by the terminal holding part 46. In addition, the connector 1 can suppress looseness of the electrical connecting part 11 in the terminal housing chamber 41. Consequently, the connector 1 has higher vibration resistance and can improve the efficiency in fitting the connector 1 with the mating connector 101. To provide the advantageous effects described above, the first housing member 30 and the second housing member 40 in the connector 1 in this example are jointly fastened to the shield shell 20B by axial force in the tube axial direction, which will be described later.

The second housing member 40 has the combinations of the terminal housing chamber 41, the cutout 42, the terminal insertion port 43, the communication chamber 44, the contact prevention part 45, and the terminal holding part 46 for the respective terminal fittings 10. The combinations are disposed such that the respective terminal fittings 10 are accommodated with their axial directions and their terminal insertion directions to the accommodation space 33 extending in the same direction. In this example, two combinations are provided. One of the combinations is formed and disposed such that the electrical connecting part 11 of the terminal fitting 10 is accommodated in the terminal housing chamber 41 with the first end surface 11*e* disposed facing the terminal insertion port 43 (that is, with the first wall surface 11*a* and the second wall surface 11*b* extending along the tube axial direction of the outer peripheral wall 31). The electrical connecting part 11 is inserted into the terminal housing chamber 41 from the first end surface 11*e* side. The other of the combinations is formed and disposed such that the electrical connecting part 11 of the terminal fitting 10 is accommodated in the terminal housing chamber 41 with the second end surface 11*f* disposed facing the terminal insertion port 43 (that is, with the first wall surface 11*a* and the second wall surface 11*b* extending along the tube axial direction of the outer peripheral wall 31). The electrical connecting part 11 is inserted into the terminal housing chamber 41 from the second end surface 11*f* side.

The following describes the shield shell 20B.

The shield shell 20B is a first shield member that suppresses intrusion of noise from outside to the components from the housing 20A to which the first housing member 30 and the second housing member 40 are attached to the terminal of the electric wire We. The shield shell 20B accommodates the components and covers them from outside. The shield shell 20B is made of a conductive material, such as a metal. The shield shell 20B includes a main shield 51 and sub-shields 52 (FIGS. 1 to 5, 13, and 14). The main shield 51 is opened on the opening 32 side and covers the housing 20A from outside. The sub-shield 52 covers, from outside, the electric wire connecting part 12 and the terminal of the electric wire We protruding outside the housing 20A from the insertion hole 34.

The main shield 51 has a tubular outer peripheral wall 51*a* the first end of which is opened and the second end of which is closed (FIGS. 1 to 5, 13, and 14). The outer peripheral wall 51*a* in this example has a rectangular tubular shape corresponding to the outer shape of the first housing member 30 having a rectangular tubular shape. In the main shield 51, the first housing member 30 is inserted into an accommodation space 51*c* (FIG. 14) along the tube axial direction from an opening 51*b* (FIGS. 2, 4, and 14) at the first end. The seal member Se1 is closely in contact with the inner peripheral surface of the outer peripheral wall 51*a* when the first housing member 30 is accommodated in the accommodation space 51*c*, thereby improving the liquid-tightness between the connector fitting part 31*a* and the main shield 51 (FIG. 4).

Figure 14:
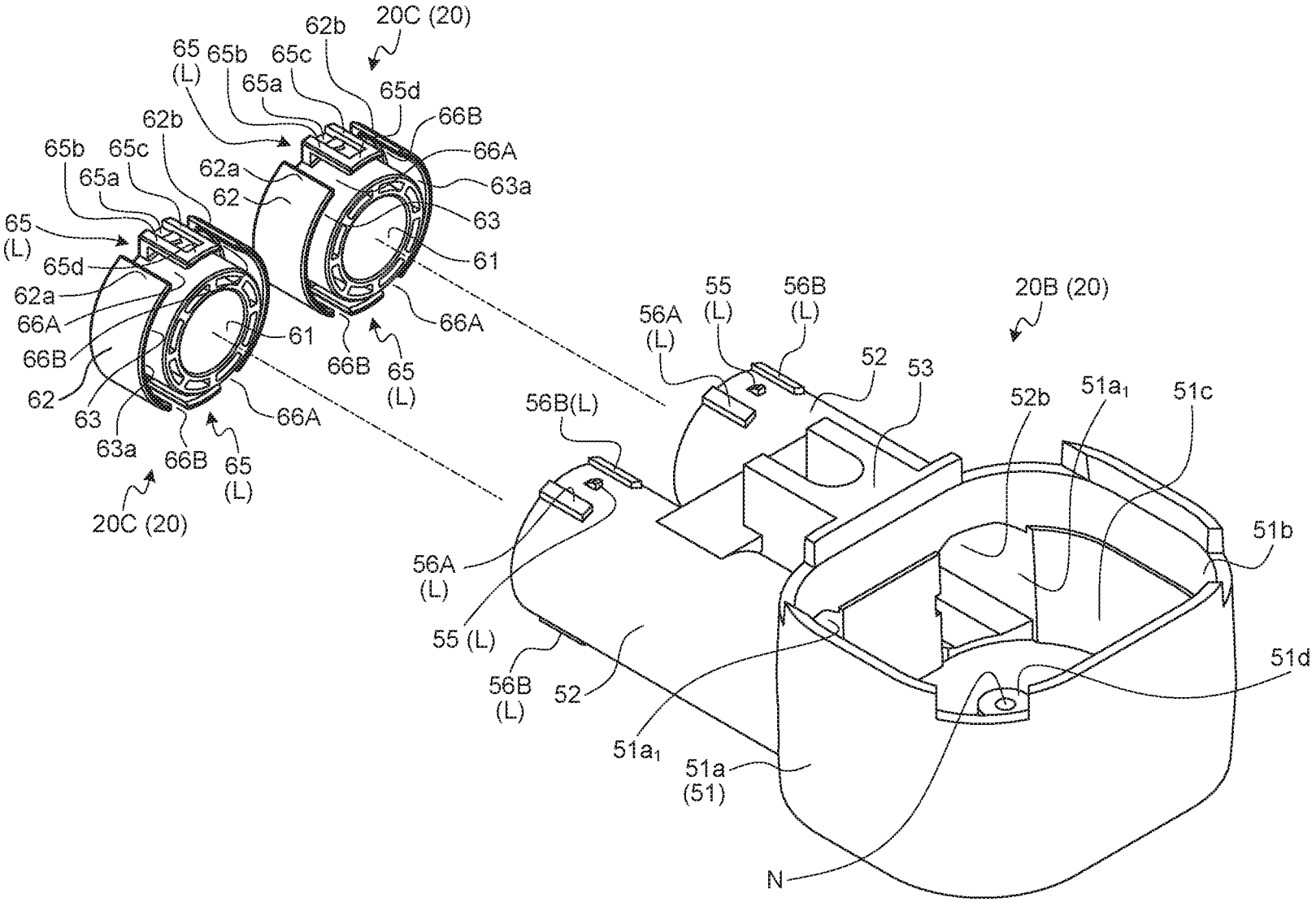
FIG. 14 is an exploded perspective view of the shield shell and the holding member viewed from an opening.

The outer peripheral wall 51*a* has through holes 51$a_1$ each disposed facing the insertion hole 34 when the first housing member 30 is accommodated in the accommodation space 51*c* (FIG. 14). The through holes 51$a_1$ are formed for the respective terminal fittings 10. In this example, two through holes 51$a_1$ are formed.

The sub-shields 52 are provided for the respective terminal fittings 10. In this example, two sub-shields 52 are provided. The sub-shield 52 has a tubular shape opened at both ends. The sub-shield 52 in this example has a cylindrical shape. In the shield shell 20B, the sub-shield 52 protrudes outside the main shield 51 from the periphery of the through hole 51$a_1$ of the main shield 51. The sub-shield 52 in this example protrudes with its tube axial direction extending along the terminal insertion direction. In the sub-shield 52, the terminal fitting 10 is inserted into an accommodation space 52*b* from an opening 52*a* at the free end (FIG. 5). The terminal fitting 10 is inserted into the accommodation space 33 from the distal end through the through hole 51$a_1$ of the main shield 51 and the insertion hole 34 of the first housing member 30.

The shield shell 20B has a coupler 53 that couples the two sub-shields 52 disposed side by side (FIGS. 2 to 5 and 13). The coupler 53 in this example is provided between the two sub-shields 52. The coupler 53 has a through hole 54 used to fix the connector 1 to the mating connector 101 (FIG. 3). The through hole 54 will be described later in greater detail.

An annular seal member Se2 is coaxially attached to the terminal of the electric wire We (FIGS. 4 and 5). The seal member Se2 is closely in contact with the inner peripheral surface of the sub-shield 52 when the electrical connecting part 11 is accommodated in the accommodation space 33, thereby improving the liquid-tightness between the sub-shield 52 and the electric wire We (FIG. 4).

The holding member 20C has a tubular outer peripheral wall (an outer peripheral wall 62, which will be described later) into which the end of the sub-shield 52 on the opening 52*a* side is fitted. The holding member 20C is a tubular member that enables leading out the electric wire We extending in the accommodation space 52*b* of the sub-shield 52 to the outside. The holding member 20C is made of a conductive material, such as a metal. The holding members 20C are provided for the respective terminal fittings 10. In this example, two holding members 20C are provided.

Figure 13:
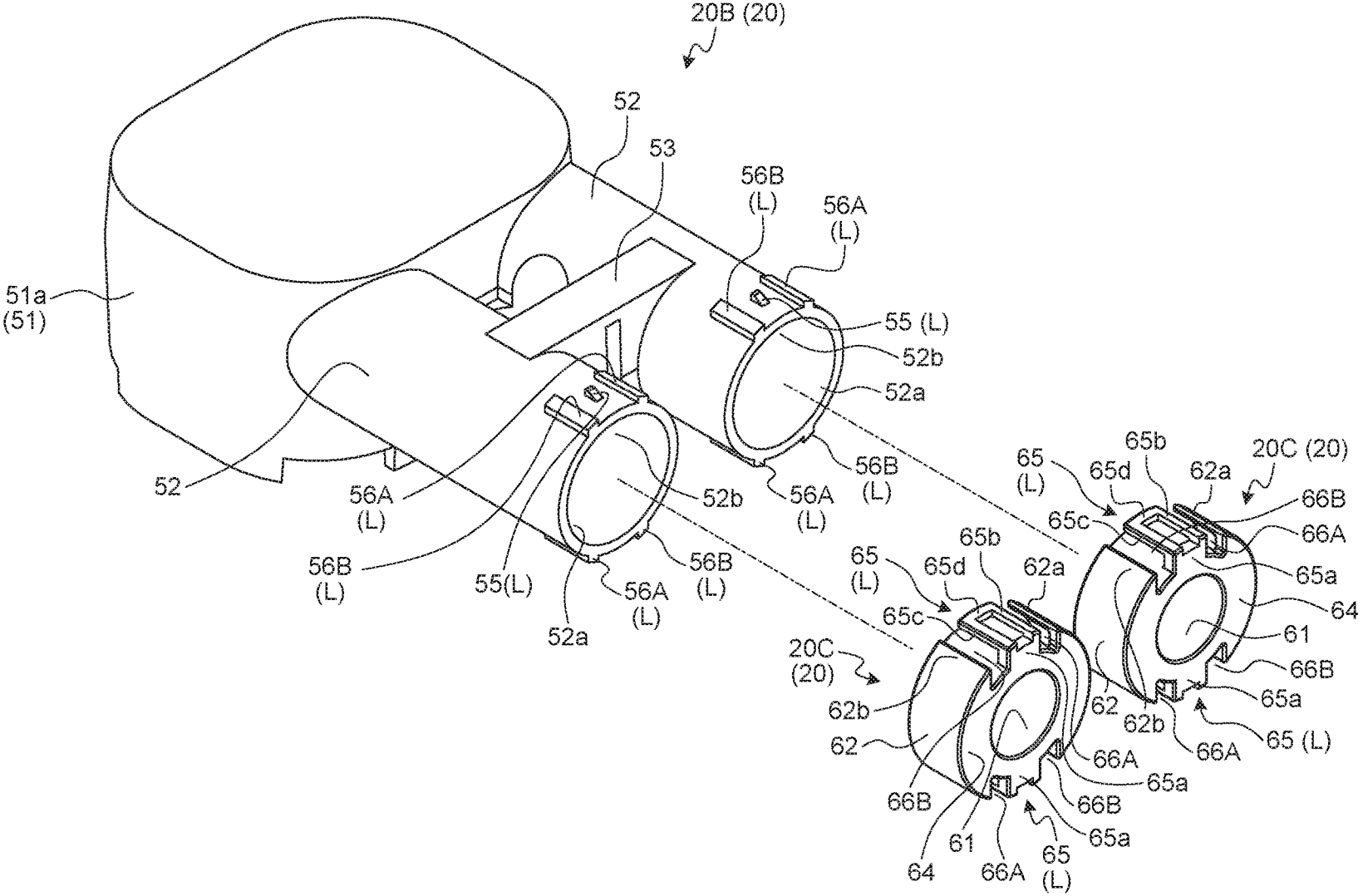
FIG. 13 is an exploded perspective view of a shield shell and a holding member.

The holding member 20C in this example has a cylindrical inner peripheral wall 61 and a cylindrical outer peripheral wall 62 disposed coaxially with a space interposed therebetween in the radial direction (FIGS. 13 and 14). Both ends of the inner peripheral wall 61 and the outer peripheral wall 62 in their tube axial direction are opened. With this structure, the holding member 20C has a cylindrical space 63 between the inner peripheral wall 61 and the outer peripheral wall 62 (FIG. 14). In the holding member 20C in this example, a ring-shaped opening at a first end in the tube axial direction in the cylindrical space 63 is covered with a wall having a ring shape (hereinafter, referred to as "ring-shaped wall") 64 (FIG. 13). In the holding member 20C, the end of the sub-shield 52 on the opening 52*a* side is inserted and fitted into the cylindrical space 63 from an opening 63*a* (FIG. 14) at a second end in the tube axial direction. In the holding member 20C, the inner peripheral wall 61 is inserted into the accommodation space 52*b* of the sub-shield 52, and the outer peripheral wall 62 covers the outer peripheral surface of the sub-shield 52. In the holding member 20C, the electric wire We extending in the accommodation space 52*b* of the sub-shield 52 is guided to the space inside the inner peripheral wall 61 and led out from the opening at the first end of the inner peripheral wall 61 to the outside.

The sub-shield 52 and the holding member 20C are kept fitted with each other by a lock mechanism L (FIGS. 13 and 14). In this example, the lock mechanisms L are provided at two positions. The lock mechanism L includes a first engaging body 55 and a second engaging body 65. The first engaging body 55 is provided on the sub-shield 52. The second engaging body 65 is provided on the holding member 20C.

The first engaging body 55 protrudes outward in the radial direction from the outer peripheral surface of the sub-shield 52 at the end on the opening 52*a* side. The first engaging body 55 in this example has a claw shape that can catch the second engaging body 65.

By contrast, the second engaging body 65 is formed by removing part of the outer peripheral wall 62 of the holding member 20C in the circumferential direction. The second engaging body 65 in this example has a base 65*a* protruding outward in the radial direction from the outer peripheral surface of the inner peripheral wall 61 on the same plane as that of the ring-shaped wall 64 (FIGS. 13 and 14). The second engaging body 65 in this example also has a first flexible shaft 65*b* and a second flexible shaft 65*c* having flexibility at both ends of the base 65*a* in the circumferential direction (FIGS. 13 and 14). The first flexible shaft 65*b* and the second flexible shaft 65*c* protrude from both ends of the base 65*a* in the circumferential direction toward the opening 63*a* in the tube axial direction of the holding member 20C. The first flexible shaft 65*b* and the second flexible shaft 65*c* are disposed at substantially the same position as that of the outer peripheral wall 62 in the radial direction of the holding member 20C. The second engaging body 65 in this example also has an engagement part 65*d* coupling the respective ends of the first flexible shaft 65*b* and the second flexible shaft 65*c* on the side toward which they protrude (FIGS. 13 and 14). In the second engaging body 65, the first flexible shaft 65*b* and the second flexible shaft 65*c* are bent, thereby moving the engagement part 65*d* in the radial direction with respect to the inner peripheral wall 61.

In the lock mechanism L, by starting to insert and fit the holding member 20C into the end of the sub-shield 52 on the opening 52*a* side, the engagement part 65*d* goes up onto the first engaging body 55 while bending the second engaging body 65. When fitting of the sub-shield 52 with the holding member 20C is finished, the engagement part 65*d* of the second engaging body 65 climbs over the first engaging body 55 in the lock mechanism L, thereby eliminating bending of the second engaging body 65. As a result, the first engaging body 55 and the engagement part 65*d* of the second engaging body 65 can be locked in the tube axial direction of the outer peripheral wall 62 to prevent the holding member 20C from coming off the sub-shield 52.

The sub-shield 52 has a locking body on the outer peripheral surface at the end on the opening 52*a* side. The locking body is a protrusion protruding from the outer peripheral surface of the sub-shield 52 at the end on the opening 52*a* side. A plurality of locking bodies are preferably provided on the outer peripheral surface. The holding member 20C has a gap into which the locking body is inserted on the outer peripheral wall 62. In the lock mechanism L, the locking body is inserted into the gap when the holding member 20C is fitted into the end of the sub-shield 52 on the opening 52*a* side and engagement of the first engaging body 55 and the second engaging body 65 is finished. In this example, two locking bodies (a first locking body 56A and a second locking body 56B) are provided on the sub-shield 52, and two gaps (a first gap 66A and a second gap 66B) are formed on the holding member 20C (FIGS. 13 and 14). In the lock mechanism L, the first locking body 56A is inserted into the first gap 66A, and the second locking body 56B is inserted into the second gap 66B when the holding member 20C is fitted into the end of the sub-shield 52 on the opening 52*a* side and engagement of the first engaging body 55 and the second engaging body 65 is finished.

Specifically, the first locking body 56A and the second locking body 56B in this example protrude outward in the radial direction from the outer peripheral surface of the sub-shield 52 at the end on the opening 52*a* side and extend in the tube axial direction of the sub-shield 52. The first locking body 56A and the second locking body 56B have a rectangular parallelepiped shape. The first locking body 56A and the second locking body 56B are formed on the outer peripheral surface of the sub-shield 52 at the end on the opening 52*a* side in a manner sandwiching the first engaging body 55 in the circumferential direction of the sub-shield 52. By contrast, the outer peripheral wall 62 has a first end 62*a* and a second end 62*b* defined by the first gap 66A and the second gap 66B (FIGS. 13 and 14). The first end 62*a* corresponds to one of the wall surfaces in the first gap 66A. The second end 62*b* corresponds to one of the wall surfaces in the second gap 66B. The first gap 66A in this example is formed between the first end 62*a* and the first flexible shaft 65*b* in the circumferential direction of the outer peripheral wall 62 (FIGS. 13 and 14). The second gap 66B in this example is formed between the second end 62*b* and the second flexible shaft 65*c* in the circumferential direction of the outer peripheral wall 62 (FIGS. 13 and 14).

The first locking body 56A and the first gap 66A are formed and disposed as follows: when the first locking body 56A is inserted into the first gap 66A, a first end and a second end of the first locking body 56A in the circumferential direction are disposed between the first end 62*a* of the outer peripheral wall 62 and the first flexible shaft 65*b* with the first end facing the first end 62*a* and the second end facing the first flexible shaft 65*b* in the circumferential direction. The first locking body 56A and the first gap 66A are formed and disposed so as to suppress relative rotation between the sub-shield 52 and the holding member 20C in the circumferential direction. The first locking body 56A and the first gap 66A, for example, are formed and disposed so as to minimize the distance between the first end of the first locking body 56A in the circumferential direction and the first end 62*a* of the outer peripheral wall 62 and the distance between the second end of the first locking body 56A in the circumferential direction and the first flexible shaft 65*b* within the range that enables insertion of the first locking body 56A into the first gap 66A. With this structure, the first locking body 56A is locked in the circumferential direction by the first end 62*a* of the outer peripheral wall 62 or the first flexible shaft 65*b* when the sub-shield 52 and the holding member 20C start to relatively rotate in the circumferential direction. Consequently, the first locking body 56A and the first gap 66A can suppress relative rotation of the sub-shield 52 and the holding member 20C in the circumferential direction.

Similarly, the second locking body 56B and the second gap 66B are formed and disposed as follows: when the second locking body 56B is inserted into the second gap 66B, a first end and a second end of the second locking body 56B in the circumferential direction are disposed between the second end 62*b* of the outer peripheral wall 62 and the second flexible shaft 65*c* with the first end facing the second end 62*b* and the second end facing the second flexible shaft 65*c* in the circumferential direction. The second locking body 56B and the second gap 66B are formed and disposed so as to suppress relative rotation between the sub-shield 52 and the holding member 20C in the circumferential direction. The second locking body 56B and the second gap 66B, for example, are formed and disposed so as to minimize the distance between the first end of the second locking body 56B in the circumferential direction and the second end 62*b* of the outer peripheral wall 62 and the distance between the second end of the second locking body 56B in the circumferential direction and the second flexible shaft 65*c* within the range that enables insertion of the second locking body 56B into the second gap 66B. With this structure, the second locking body 56B is locked in the circumferential direction by the second end 62*b* of the outer peripheral wall 62 or the second flexible shaft 65*c* when the sub-shield 52 and the holding member 20C start to relatively rotate in the circumferential direction. Consequently, the second locking body 56B and the second gap 66B can suppress relative rotation of the sub-shield 52 and the holding member 20C in the circumferential direction.

Besides the shield shell 20B serving as the first shield member, the connector 1 also includes second shield members 71 electrically connected to the shield shell 20B (FIGS. 1 to 5 and 15). The second shield member 71 covers, from outside, the end of the sub-shield 52 on the opening 52*a* side and the electric wire We led out from the opening 52*a*, thereby suppressing intrusion of noise from outside to the electric wire We. The second shield members 71 have a tubular shape and are provided for the respective terminal fittings 10. In this example, two second shield member 71 are provided. In the connector 1, the electric wire We is led out from the holding member 20C attached to the opening 52*a* of the sub-shield 52 to the outside. The second shield member 71 covers, from outside, the end of the sub-shield 52 on the opening 52*a* side, the holding member 20C, and the electric wire We led out from the holding member 20C. With this structure, the second shield member 71 can suppress intrusion of noise from outside to the electric wire We led out from the holding member 20C. Specifically, the second shield member 71 in this example is a braid made of conductive strands braided into a tubular and mesh shape. With this structure, the second shield member 71 in this example has flexibility and can follow a movement, such as bending, of the electric wire We inside thereof. For convenience of illustration, the specific shape (e.g., a mesh shape) of the second shield member 71 is not illustrated in the figures.

Figure 15:
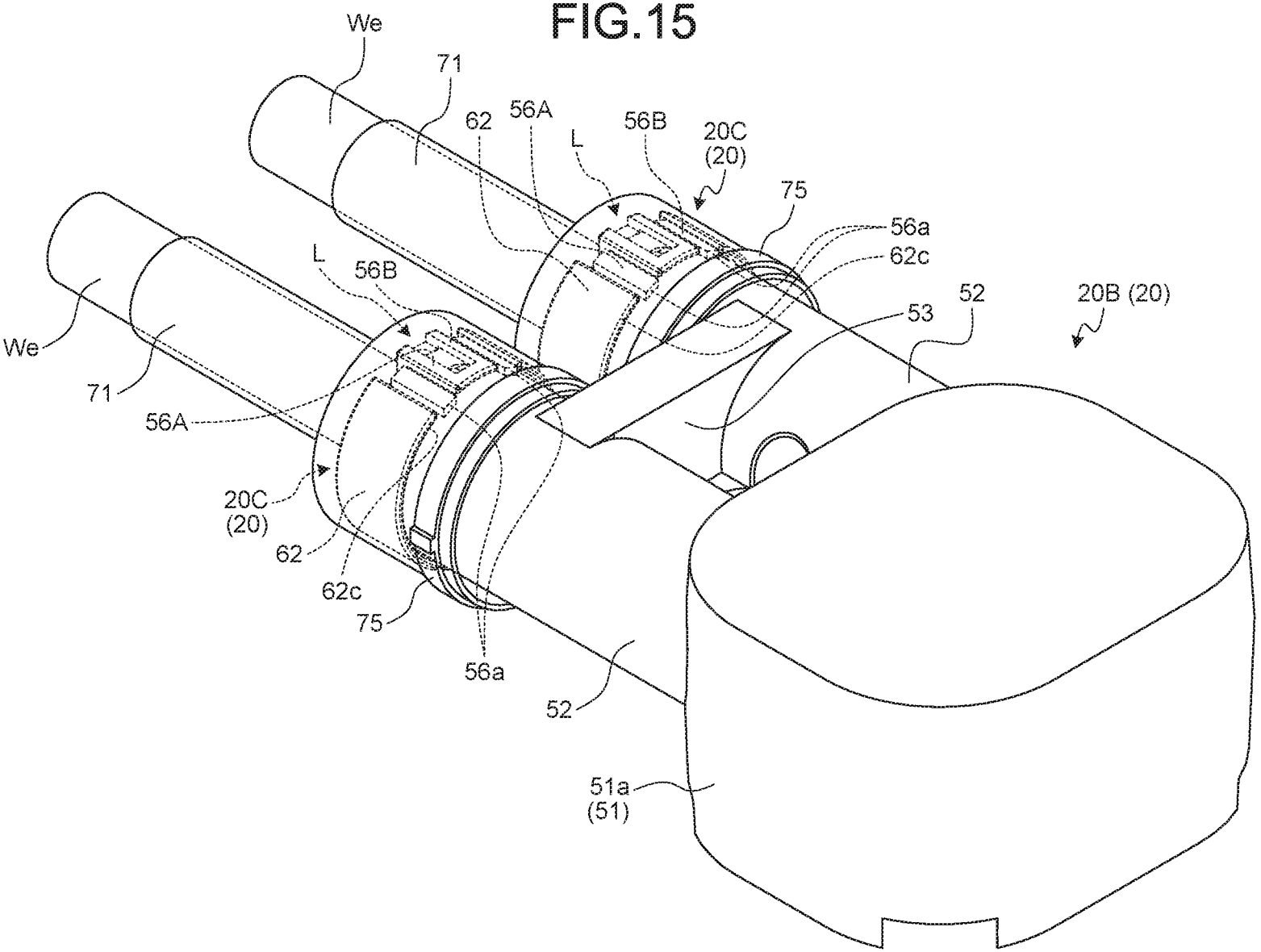
FIG. 15 is a perspective view for explaining a fixed state of a sub-shield and a second shield member.

The second shield member 71 is fixed to the sub-shield 52 with a binding member (a binding band 75) made of a conductive material, such as a metal (FIGS. 4, 5, and 15). The binding band 75 is a known one in the present technical field. The binding band 75, for example, is wound around the second shield member 71 and the end of the sub-shield 52 on the opening 52*a* side over the second shield member 71. The binding band 75 is tightened into a ring shape, thereby fixing the second shield member 71 to the end of the sub-shield 52 on the opening 52*a* side.

The binding band 75 is wounded at a position facing an end surface 62*c* of the outer peripheral wall 62 of the holding member 20C on the opening 63*a* side and end surfaces 56*a* of the first locking body 56A and the second locking body 56B on the main shield 51 side in the tube axial direction of the sub-shield 52 (FIG. 15). As a result, the binding band 75 having an annular shape (a ring shape in this example) after being wounded is disposed facing the end surface 62*c* of the outer peripheral wall 62 and the end surfaces 56*a* of the first locking body 56A and the second locking body 56B in the tube axial direction. In this example, the end surfaces 56*a* of the first locking body 56A and the second locking body 56B protrude with respect to the end surface 62*c* of the outer peripheral wall 62 in the tube axial direction. With this structure, the end surfaces 56*a* of the first locking body 56A and the second locking body 56B can be used as a locking part that can lock the tightened binding band 75 in the tube axial direction. When pulling force is generated in this connector 1 in a direction extracting the second shield member 71 from the sub-shield 52, and the binding band 75 is relatively moved with respect to the sub-shield 52 together with the second shield member 71 in the tube axial direction, for example, the binding band 75 is locked by the end surfaces 56*a* of the first locking body 56A and the second locking body 56B. As a result, the connector 1 can keep the second shield member 71 tightened around the sub-shield 52. Consequently, the connector 1 can maintain the physical and electrical connected state between the sub-shield 52 and the second shield member 71, thereby suppressing deterioration of the shield performance. As described above, in the connector 1, the first locking body 56A and the second locking body 56B have a function of holding the second shield member 71 with respect to the sub-shield 52 and a function of preventing relative rotation of the holding member 20C with respect to the sub-shield 52. Consequently, the connector 1 can be downsized compared with a case where the functions described above are implemented by respective different parts.

In the connector 1, the sub-shields 52 of the shield shell 20B are provided for the respective terminal fittings 10. The second shield members 71 are coupled to the respective sub-shields 52, thereby covering the respective electric wires We. With this structure, the connector 1 enables leading out the electric wires We from the respective sub-shield 52 while maintaining their flexibility compared with a case where bundled electric wires We are covered with one braid. Consequently, the connector 1 can have higher flexibility in arrangement of the electric wires We. In addition, the connector 1 can suppress thermal interference between the electric wires We because the electric wires We need not be bundled. As a result, the electric wires We can have a smaller diameter. Consequently, the connector 1 can have still higher flexibility in arrangement of the electric wires We.

In the connector 1, the electric wire connecting part 12 of the terminal fitting 10 protrudes from the insulating housing 20A and is covered with the conductive sub-shield 52 as described above. In the connector 1, an insulator is provided between the conductive electric wire connecting part 12 and the sub-shield 52 to increase the insulation distance (the clearance and the creepage distance) therebetween. The connector 1 includes an insulating tubular member (hereinafter, referred to as an "insulating tube") 80 that covers the electric wire connecting part 12 and the terminal of the electric wire We from outside (FIGS. 3 to 5, 16, and 17).

The insulating tube 80 is made of an insulating material, such as a synthetic resin. The insulating tube 80 in this example has a tube 81 having a rectangular tube shape that accommodates the electric wire connecting part 12 and the terminal of the electric wire We (FIGS. 4, 5, 16, and 17). A first end of the tube 81 in the tube axial direction is inserted into the accommodation space 33 of the first housing member 30 with the electric wire connecting part 12 accommodated therein. As a result, the terminal fitting 10 is inserted into the accommodation space 33 through the insertion hole 34 from the distal end on the electrical connecting part 11 side together with a first end of the insulating tube 80 in its tube axial direction. In the connector 1, the insertion hole 34 of the first housing member 30 preferably has a substantially rectangular shape, and the tube 81 is preferably formed such that it can be inserted into the insertion hole 34. In the housing 20A, the second housing member 40 is inserted into the accommodation space 33 with the first end of the insulating tube 80 and the electrical connecting part 11 accommodated in the accommodation space 33.

Figure 16:
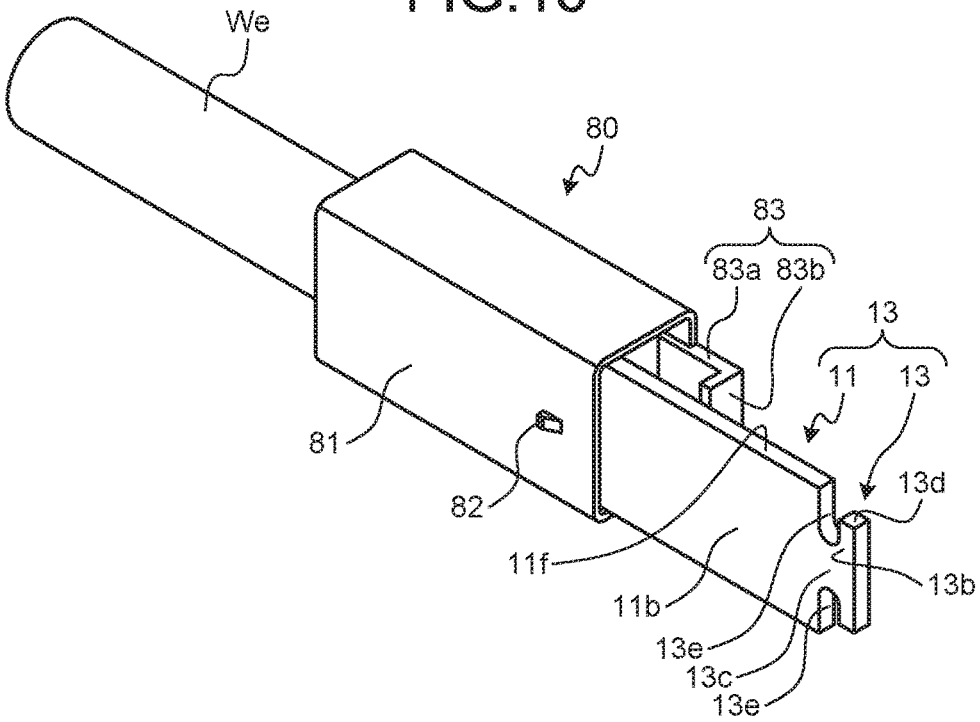
FIG. 16 is a perspective view of an insulating tube, the terminal fitting, and the electric wire.
Figure 17:
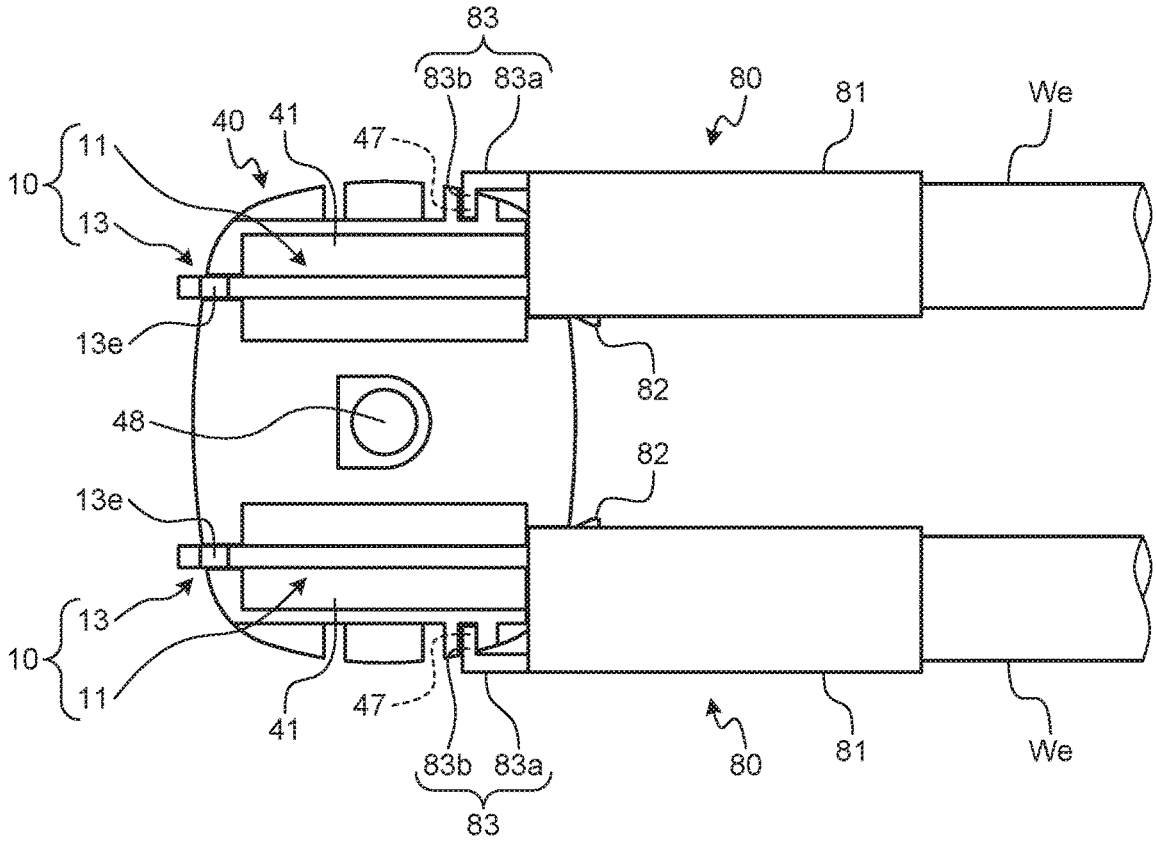
FIG. 17 is a plan view for explaining an engaged state of the insulating tubes and the second housing member.

The insulating tube 80 in this example includes a locking claw 82 at the first end in its tube axial direction (FIGS. 3, 5, 16, and 17). In this example, the locking claw 82 is provided at at least one position at the first end of the tube 81 in the tube axial direction. The locking claw 82 is formed as a protrusion on the outer peripheral wall of the tube 81 on the first end side and accommodated in the accommodation space 33. The locking claw 82 can be fixed to the periphery of the insertion hole 34 on the outer peripheral wall 31 of the first housing member 30 in the tube axial direction of the tube 81 the first end of which is accommodated in the accommodation space 33 (FIGS. 3 and 17). As a result, the locking claw 82 can temporarily fix the insulating tube 80 to the first housing member 30 until the second housing member 40 is accommodated in the accommodation space 33.

In the connector 1, a locked part 83 (FIGS. 3, 5, 16, and 17) is provided on the insulating tube 80, and a locking part 47 (FIGS. 10, 11, and 17) is provided on the second housing member 40. The locked part 83 and the locking part 47 prevents a movement of the insulating tube 80 with respect to the housing 20A in its tube axial direction. The locked part 83 and the locking part 47 may have any desired shapes as long as they can prevent the movement. One of the locked part 83 and the locking part 47 has a protruding shape, for example, and the other thereof has a groove-like shape into which the mating one is inserted. The insulating tube 80 in this example has the locked part 83 at the first end in its tube axial direction. In this example, the locked part 83 is provided at the first end of the tube 81 in the tube axial direction. The locked part 83 is provided as a piece protruding from the first end of the tube 81 in the tube axial direction. The locked part 83 in this example has an L-shape including a first piece 83*a* and a second piece 83*b* (FIGS. 16 and 17). The first piece 83*a* protrudes from the first end of the tube 81 in the tube axial direction. The second piece 83*b* is disposed orthogonally to the first piece 83*a*. The first end of the insulating tube 80 is inserted into the accommodation space 33 from the insertion hole 34 with the direction orthogonal to the L-shaped section of the locked part 83 extending along the tube axial direction of the first housing member 30. The second housing member 40 has the groove-like locking part 47 that accommodates the second piece 83*b* in the accommodation space 33 (FIGS. 10, 11, and 17). The locking part 47 is a groove extending along the tube axial direction of the first housing member 30 for the corresponding insulating tube 80. The second piece 83*b* is inserted into the locking part 47 along the tube axial direction of the first housing member 30 as the second housing member 40 is inserted into the accommodation space 33. The second piece 83*b* can be locked by two side walls of the locking part 47 (walls disposed facing each other along the tube axial direction of the tube 81). Consequently, the connector 1 can suppress positional deviation of the insulating tube 80 with respect to the housing 20A and the shield shell 20B in the tube axial direction.

Figure 2:
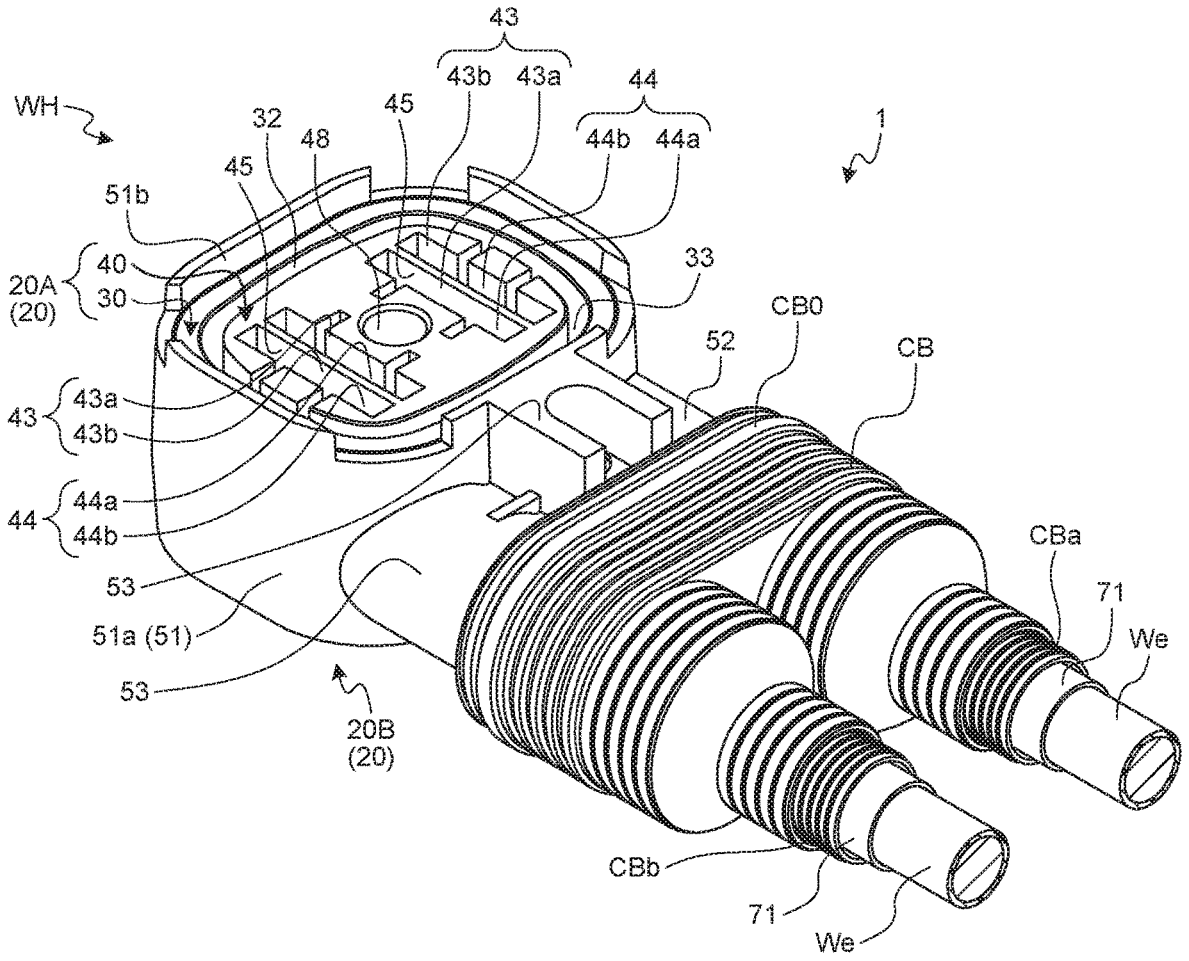
FIG. 2 is a perspective view of the connector and the electric wire with the connector according to the embodiment viewed from another angle.

In the connector 1, the second shield member 71 is covered with a sheath member CB from outside (FIGS. 1 to 5). The sheath member CB is a corrugated tube or a boot, for example, and made of an insulating material, such as a synthetic resin. The sheath member CB in this example is designed to be bendable for higher flexibility in arrangement of the electric wires We. The sheath member CB, for example, has bendable tubular parts CBa and CBb for the respective electric wires We led out from the holding member 20C (FIGS. 1 to 3). The sheath member CB is fixed to the shield shell 20B with a binding band CB0, for example.

Figure 12:
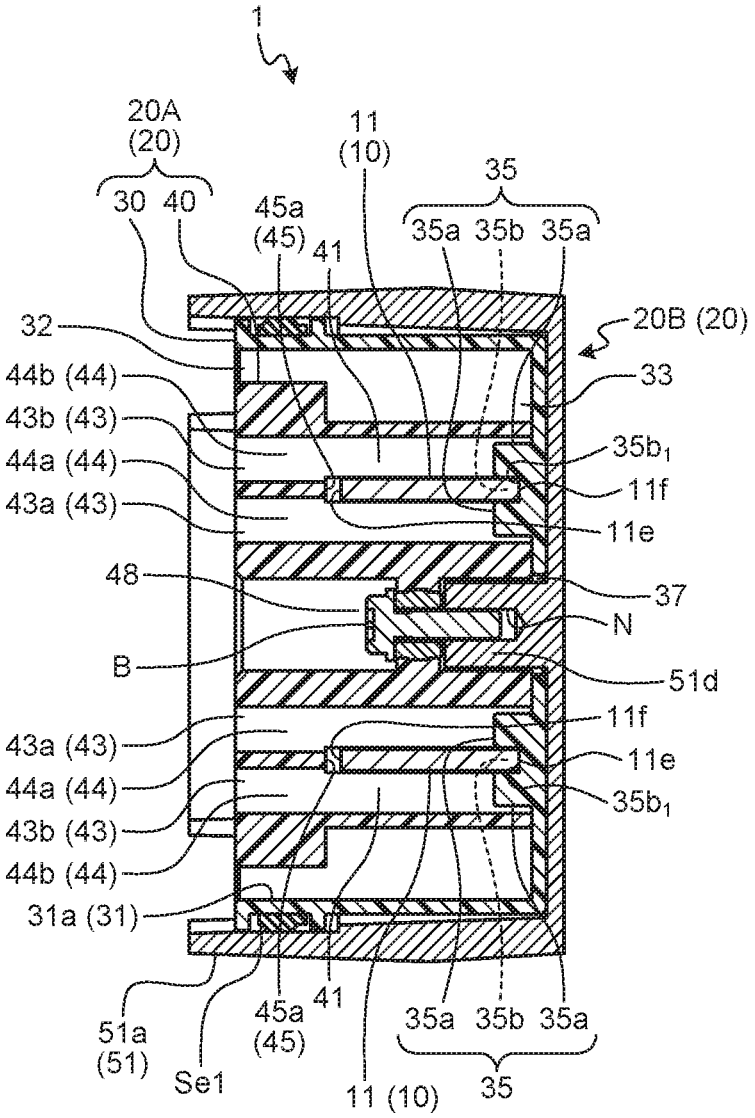
FIG. 12 is a sectional view along line Y-Y of FIG. 3.

In the connector 1, the first housing member 30 is accommodated in the accommodation space 51*c* of the main shield 51, and the terminal fittings 10 attached to the respective terminals of the electric wires We and inserted into the insulating tubes 80 are accommodated in the accommodation space 33 of the first housing member 30 from their distal ends. In the connector 1, the second housing member 40 is inserted into the accommodation space 33 while maintaining the state described above. In the connector 1, the first housing member 30, the second housing member 40, and the shield shell 20B are screwed to maintain the fixed state of the parts described above. The main shield 51 in this example has a female screw part N having the axial direction extending along its tube axial direction, for example (FIGS. 12 and 14). The first housing member 30, the second housing member 40, and the shield shell 20B are fixed by a male screw member B (FIG. 5) screwed into the female screw part N. The first housing member 30 has a through hole 37 through which a cylindrical boss 51*d* (FIGS. 12 and 14) having the female screw part N is inserted (FIGS. 3, 5, and 12). The second housing member 40 has a through hole 48 through which the male screw member B is inserted (FIGS. 3, 5, 11, and 12). The axial direction of the through holes 37 and 48 corresponds to the tube axial direction of the outer peripheral wall 31. The axial direction of the boss 51*d* corresponds to the tube axial direction of the outer peripheral wall 51*a*. With this structure, the first housing member 30, the second housing member 40, and the shield shell 20B are jointly fastened by the axial force in the tube axial direction.

The connector 1 is inserted and fitted into the mating connector 101 and electrically connected thereto as described above. The following describes the mating connector 101.

Figure 18:
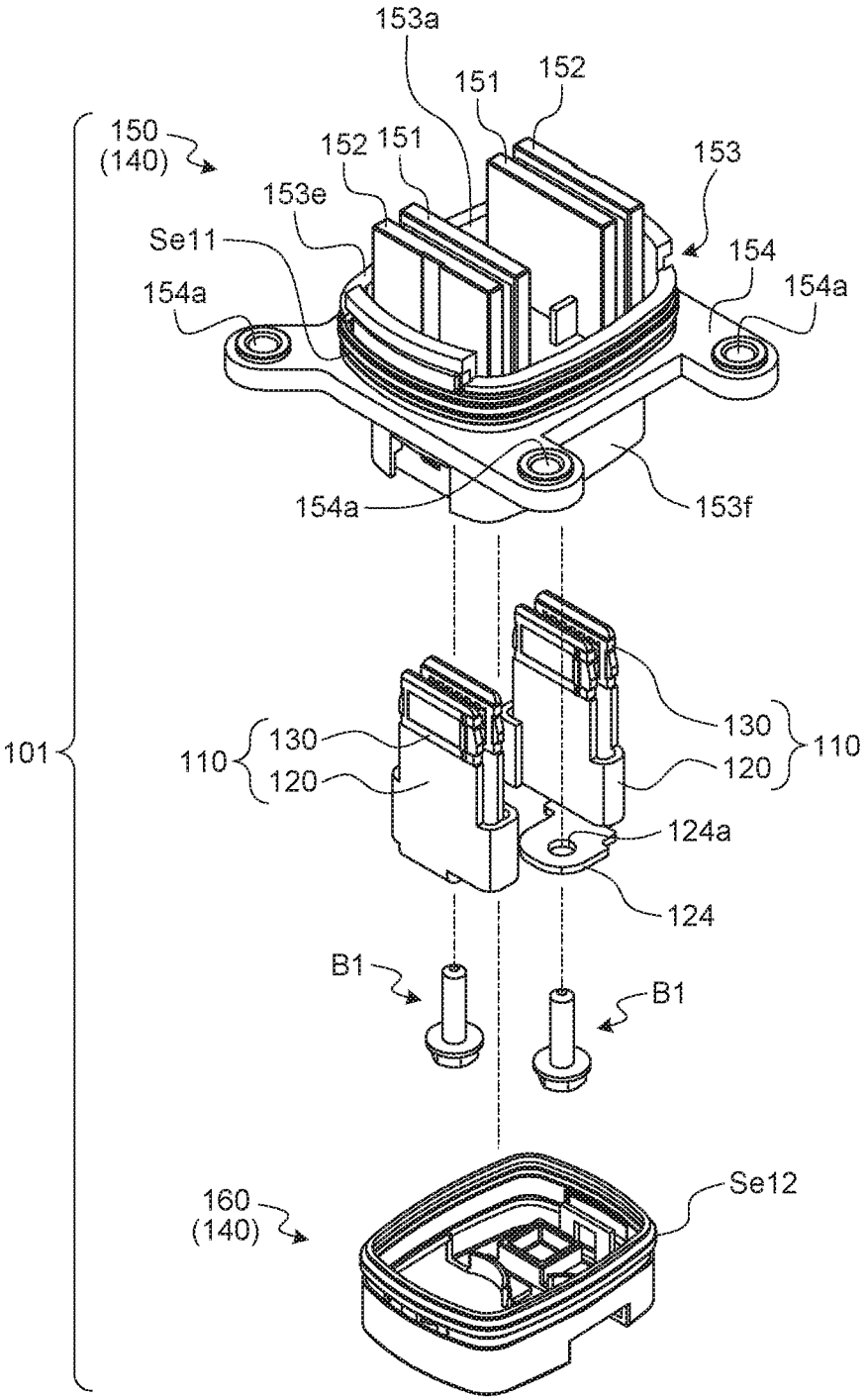
FIG. 18 is an exploded perspective view of the mating connector.
Figure 19:
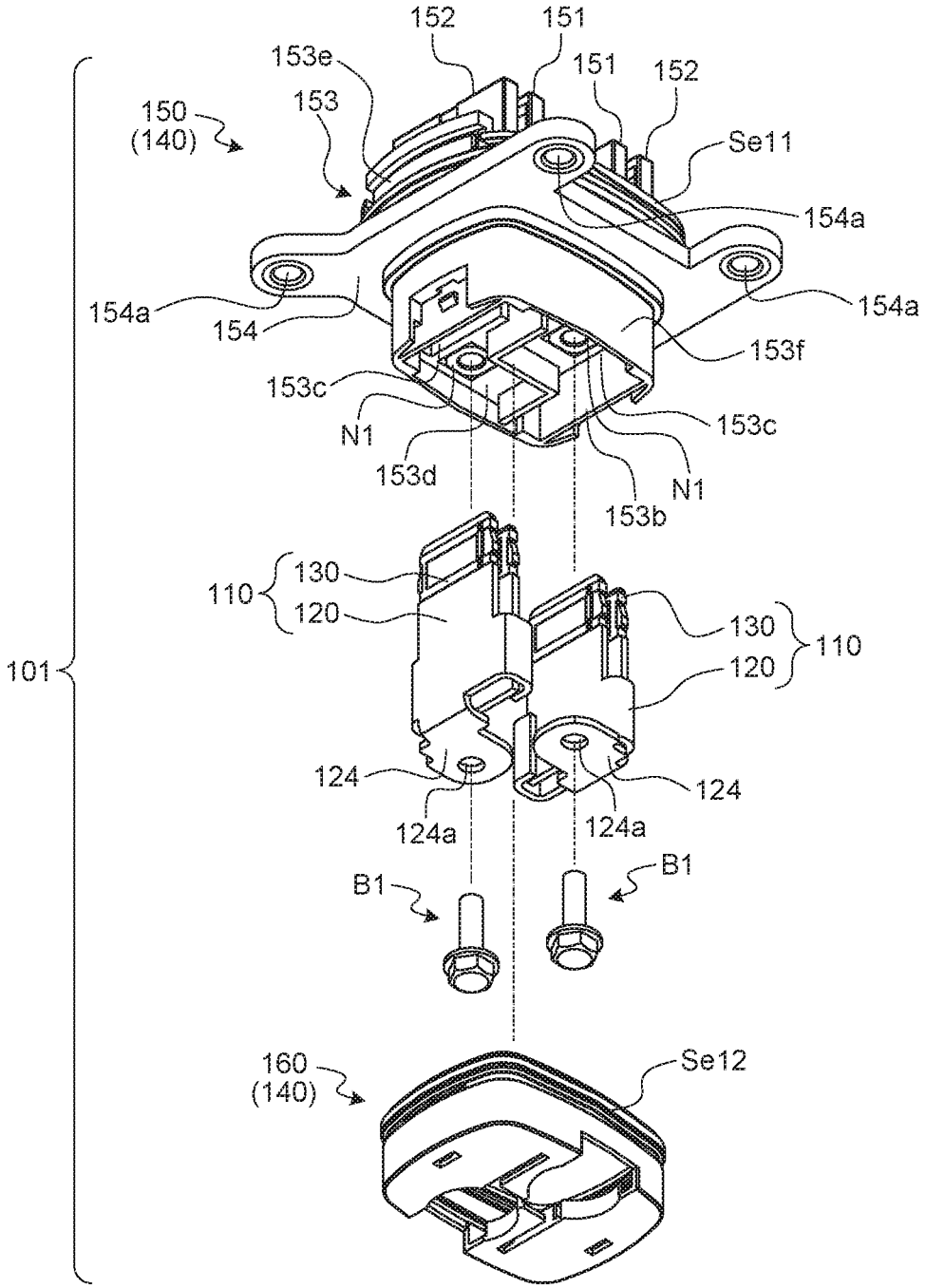
FIG. 19 is an exploded perspective view of the mating connector viewed from another angle.

The mating connector 101 includes the mating terminals 110 electrically connected to the respective terminal fittings 10 (FIGS. 18 and 19). The mating terminals 110 are provided for the respective terminal fittings 10. The mating connector 101 in this example includes two mating terminals 110.

The mating terminal 110 itself may serve as a contact part. In this case, a terminal fitting (hereinafter, referred to as a "mating terminal fitting") 120 itself serves as the mating terminal 110. Alternatively, the mating terminal 110 may include a contact member 130 attached to the mating terminal fitting 120.

The mating terminal fitting 120 is made of a conductive material, such as a metal (e.g., copper, copper alloy, aluminum, and aluminum alloy) and has a female shape. In this example, a conductive metal plate is prepared as a base material and formed into the female-shaped mating terminal fitting 120 by press working, such as cutting and bending.

Figure 20:
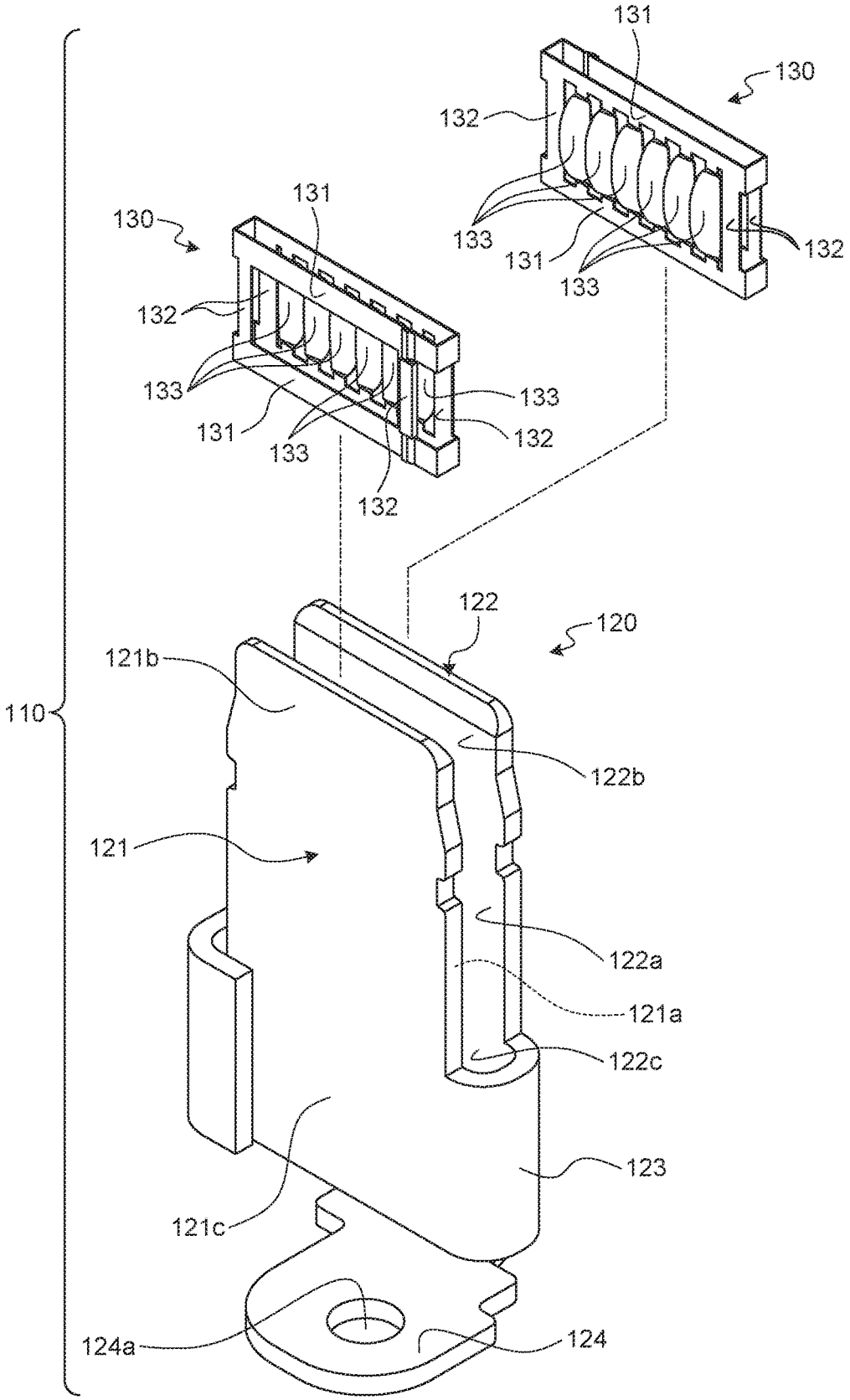
FIG. 20 is an exploded perspective view of a mating terminal.
Figure 21:
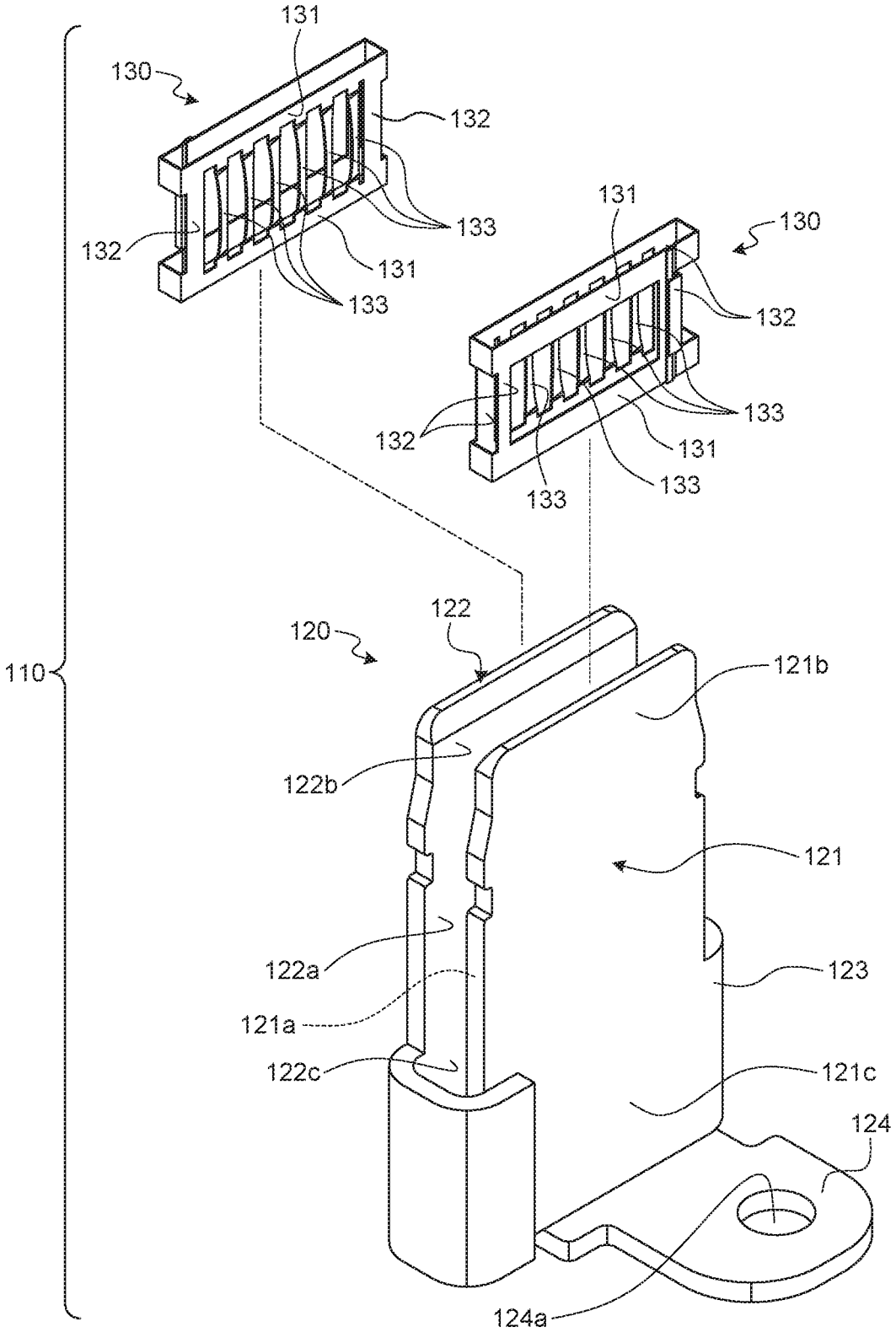
FIG. 21 is an exploded perspective view of the mating terminal viewed from another angle.

The mating terminal fitting 120 includes a first electrical connecting part 121 and a second electrical connecting part 122 disposed facing each other with a space interposed therebetween (FIGS. 20 and 21). The first electrical connecting part 121 and the second electrical connecting part 122 each have a plate shape having two flat wall surfaces. In this example, the first electrical connecting part 121 and the second electrical connecting part 122 each have a substantially rectangular plate shape. The first electrical connecting part 121 and the second electrical connecting part 122 in this example have substantially the same shape. In the mating terminal fitting 120, wall surfaces (hereinafter, referred to as "facing wall surfaces") 121*a* and 122*a* out of the two wall surfaces of the first electrical connecting part 121 and the second electrical connecting part 122 are disposed facing each other with a space interposed therebetween (FIGS. 20 and 21). The facing wall surfaces 121*a* and 122*a* are disposed in parallel facing each other with a space interposed therebetween.

In the mating terminal fitting 120, the electrical connecting part 11 is inserted between first ends 121*b* and 122*b* (FIGS. 20 and 21) of the first electrical connecting part 121 and the second electrical connecting part 122, respectively. The first electrical connecting part 121 and the second electrical connecting part 122 are electrically connected to the inserted electrical connecting part 11. The first electrical connecting part 121 and the second electrical connecting part 122 are formed and disposed as follows: one of the first wall surface 11*a* and the second wall surface 11*b* of the electrical connecting part 11 is disposed facing one of the facing wall surfaces 121*a* and 122*a* of the first ends 121*b* and 122*b*, respectively, and the other of the first wall surface 11*a* and the second wall surface 11*b* is disposed facing the other of the facing wall surfaces 121*a* and 122*a*. In other words, the first electrical connecting part 121 and the second electrical connecting part 122 are formed and disposed such that the first wall surface 11*a* and the second wall surface 11*b* each can be disposed facing either of the facing wall surfaces 121*a* and 122*a*. In this example, the facing wall surfaces 121*a* and 122*a* are disposed facing the first wall surface 11*a* and the second wall surface 11*b*, respectively, in parallel.

To use the mating terminal fitting 120 itself as a contact point with the electrical connecting part 11, the mating terminal fitting 120 has contact parts (not illustrated) on the first electrical connecting part 121 and the second electrical connecting part 122. In this case, the first electrical connecting part 121 has a swelling part swelling toward the facing wall surface 122*a* of the second electrical connecting part 122 from the facing wall surface 121*a* of the first end 121*b* as the contact part. The second electrical connecting part 122 has a swelling part swelling toward the facing wall surface 121*a* of the first electrical connecting part 121 from the facing wall surface 122*a* of the first end 122*b* as the contact part. The contact parts each have a spherical surface serving as a contact point, for example, and are disposed facing each other with a space interposed therebetween in a direction orthogonal to the facing wall surfaces 121*a* and 122*a*. The space between the contact parts is set smaller than the thickness of the electrical connecting part 11. The electrical connecting part 11 is inserted between the first electrical connecting part 121 and the second electrical connecting part 122, thereby bringing the contact parts into contact with the first wall surface 11*a* and the second wall surface 11*b* of the electrical connecting part 11. As a result, the first electrical connecting part 121 and the second electrical connecting part 122 are physically and electrically connected to the electrical connecting part 11 in the terminal housing chamber 41 of the second housing member 40 of the casing 20.

In the mating terminal fitting 120, the first electrical connecting part 121 and the second electrical connecting part 122 are coupled with a coupling part 123 (FIGS. 20 and 21). The coupling part 123 couples first side ends of second ends 121*c* and 122*c* of the first electrical connecting part 121 and the second electrical connecting part 122, respectively.

The mating terminal fitting 120 has a fixed part 124 fixed to a casing 140, which will be described later (FIGS. 20 and 21). The fixed part 124 is provided on one of the first electrical connecting part 121 and the second electrical connecting part 122. The fixed part 124 in this example has a piece-like shape and protrudes from an end of the second end 122*c* of the second electrical connecting part 122 in the connector insertion and extraction direction. The fixed part 124 protrudes in the direction orthogonal to the facing wall surface 122*a* of the second electrical connecting part 122. The fixed part 124 has a through hole 124*a* through which a male screw member B1, which will be described later, is inserted.

In a case where the contact members 130 are provided, the respective contact members 130 are attached to the first electrical connecting part 121 and the second electrical connecting part 122. The present embodiment describes this case.

Different contact members 130 may be used for the first electrical connecting part 121 and the second electrical connecting part 122. Alternatively, the same contact members 130 may be used in common for the first electrical connecting part 121 and the second electrical connecting part 122. In this example, the same contact member 130 can be shared by the first electrical connecting part 121 and the second electrical connecting part 122.

The contact members 130 are attached to the first ends 121*b* and 122*b* of the first electrical connecting part 121 and the second electrical connecting part 122, respectively, thereby being physically and electrically connected to the first electrical connecting part 121 and the second electrical connecting part 122. In other words, the mating terminal 110 includes a combination of the first electrical connecting part 121, which is one of a pair, and one of the contact members 130 in contact with each other and a combination of the second electrical connecting part 122, which is the other of the pair, and the other of the contact members 130 in contact with each other. With this structure, the contact members 130 can be brought into contact with the first wall surface 11*a* or the second wall surface 11*b* of the electrical connecting part 11 inserted between the first ends 121*b* and 122*b* of the first electrical connecting part 121 and the second electrical connecting part 122, respectively. Consequently, the contact members 130 can electrically connect the electrical connecting part 11 to the first electrical connecting part 121 and the second electrical connecting part 122.

The contact member 130 is made of a conductive material, such as a metal (e.g., copper, copper alloy, aluminum, and aluminum alloy) and has elasticity. In this example, a conductive metal plate is prepared as a base material and formed into the contact member 130 by press working, such as cutting and bending.

The contact member 130 is formed such that the first electrical connecting part 121 and the second electrical connecting part 122 can be inserted thereinto. The contact member 130 has an annular or tubular shape. The contact member 130 in this example, for example, has two annular parts 131 and four coupling parts 132 (FIGS. 20 and 21). The annular parts 131 having a rectangular tubular shape are disposed facing each other with a space interposed therebetween with their tube axial directions aligned. The coupling parts 132 couple the annular parts 131. The first end 121*b* of the first electrical connecting part 121 and the first end 122*b* of the second electrical connecting part 122 are inserted into the annular parts 131. The coupling parts 132 are disposed at the corners of the two annular parts 131, for example, to couple the corners facing each other in the tube axial direction.

The contact member 130 has at least one contact part 133 protruding outward with respect to the annular parts 131 and having elasticity between the annular parts 131 (FIGS. 20 and 21). The contact member 130 in this example has a plurality of contact parts 133 protruding by the same degree of protrusion in the same direction. In the contact part 133, both ends in the tube axial direction are coupled to the respective annular parts 131, and a curved surface at the maximum protrusion position at the center in the tube axial direction serves as the contact point. By coupling the maximum protrusion positions of the respective contact parts 133, a virtual plane (not illustrated) is formed. The virtual planes in this example are disposed facing the facing wall surfaces 121*a* and 122*a* in parallel when the first electrical connecting part 121 and the second electrical connecting part 122 are inserted into the contact members 130.

In the mating connector 101, the first electrical connecting part 121 and the second electrical connecting part 122 are inserted into the respective contact members 130 such that the virtual planes are disposed in parallel facing each other with a space interposed therebetween. As a result, the contact parts 133 in the contact members 130 are disposed facing each other in the direction orthogonal to the facing wall surfaces 121*a* and 122*a* of the first electrical connecting part 121 and the second electrical connecting part 122, respectively. The space between the virtual planes is set smaller than the thickness of the electrical connecting part 11. The electrical connecting part 11 is inserted between the contact members 130, thereby bringing the contact parts 133 into contact with the first wall surface 11*a* and the second wall surface 11*b* of the electrical connecting part 11. As a result, the first electrical connecting part 121 and the second electrical connecting part 122 are physically and electrically connected to the electrical connecting part 11 via the contact members 130 in the terminal housing chamber 41 of the second housing member 40 of the casing 20.

In a case where the contact members 130 are provided, the first electrical connecting part 121 and the second electrical connecting part 122 may have or do not necessarily have the contact parts (swelling parts) described above. If the first electrical connecting part 121 and the second electrical connecting part 122 have the contact parts (swelling parts), the same mating terminal fitting 120 can be shared by the mating connector 101 with or without the contact members 130. In this example, neither the first electrical connecting part 121 nor the second electrical connecting part 122 has the contact parts (swelling parts).

The mating connector 101 includes the casing 140 that accommodates the mating terminals 110 (FIGS. 1, 18, and 19). The casing 140 includes a housing member 150 (FIGS. 1, 18, and 19) and a holding member 160 (FIGS. 18 and 19). The housing member 150 accommodates the mating terminals 110. The holding member 160 prevents the accommodated mating terminals 110 from coming off the housing member 150.

The housing member 150 is made of an insulating material, such as a synthetic resin. The housing member 150 includes a first housing 151 and a second housing 152 (FIGS. 1, 18, and 19). The first housing 151 accommodates a combination of the first electrical connecting part 121, which is one of a pair, and one of the contact members 130. The second housing 152 accommodates a combination of the second electrical connecting part 122, which is the other of the pair, and the other of the contact members 130. The first housing 151 is formed surrounding the first electrical connecting part 121 and one of the contact members 130 with the facing wall surface 121*a* and the contact part 133 of one of the contact members 130 exposed. The second housing 152 is formed surrounding the second electrical connecting part 122 and the other of the contact members 130 with the facing wall surface 122*a* and the contact part 133 of the other of the contact members 130 exposed. The first housing 151 and the second housing 152 are disposed facing each other with a space interposed therebetween in the direction orthogonal to the facing surfaces 121*a* and 122*a*. The space is sufficiently large not to prevent insertion of the electrical connecting part 11 between the contact members 130. The housing member 150 includes the pairs of the first housing 151 and the second housing 152 for the respective mating terminals 110.

The housing member 150 includes a tube 153 having its tube axial direction extending along the connector insertion and extraction direction and opened at both ends in the tube axial direction (FIGS. 1, 18, and 19). All the combinations of the first housing 151 and the second housing 152 extend in the connector insertion direction from the inner space of the tube 153 and protrude from a first end opening 153*a* of the tube 153 (FIGS. 1 and 18). The tube 153 has insertion ports 153*c* into which the mating terminals 110 are inserted at a second end opening 153*b* (FIG. 19). The insertion ports 153*c* are formed for the respective mating terminals 110. The tube 153 has a holding part 153*d* that holds the first housing 151 and the second housing 152 and the mating terminal 110 (FIG. 19). The mating terminal 110 is fixed to the holding part 153*d* with the male screw member B1 inserted through the through hole 124*a*. A female screw member N1 into which the male screw member B1 is screwed is inserted and fitted into the holding part 153*d* (FIG. 19).

Figure 22:
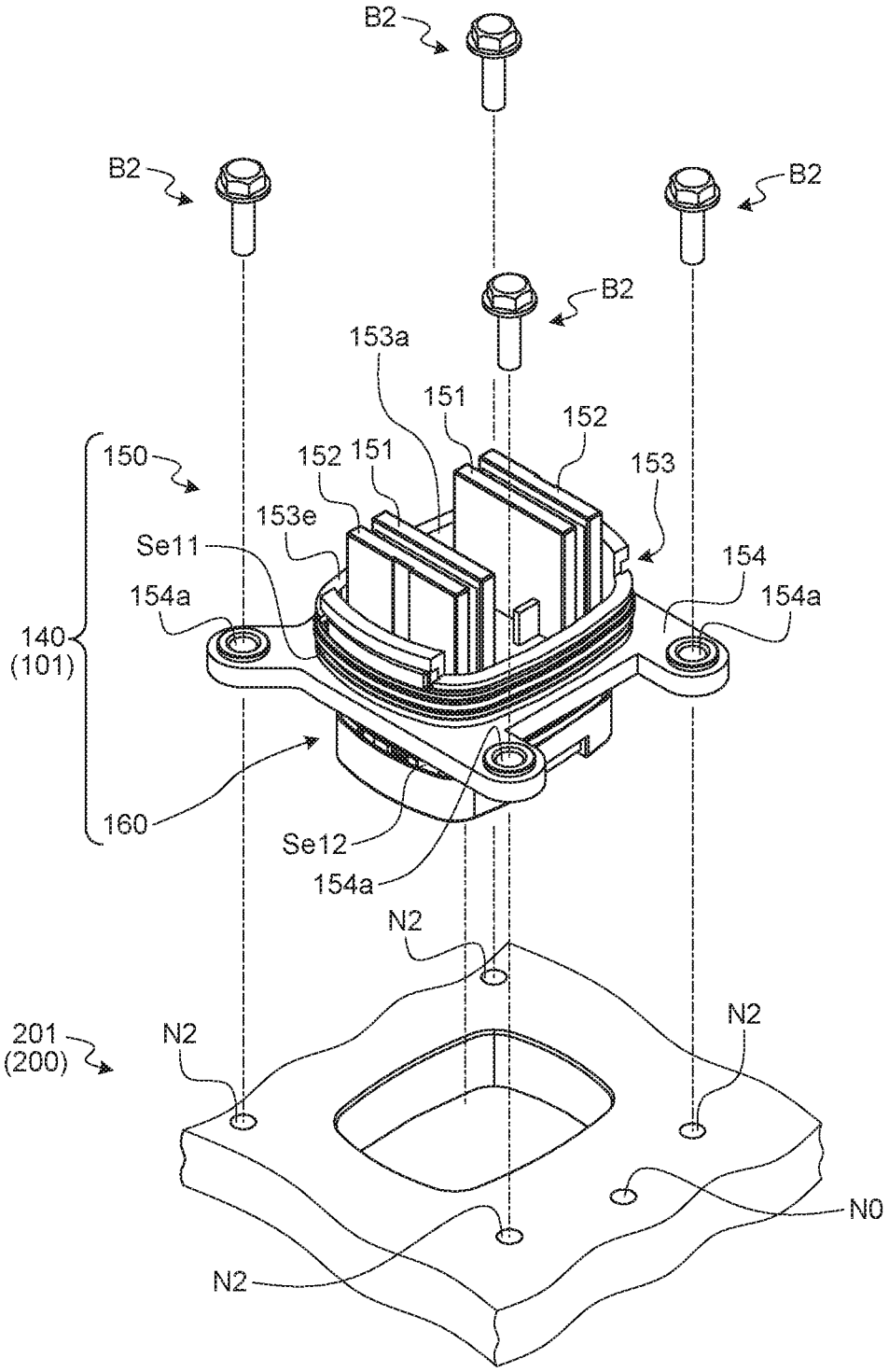
FIG. 22 is a perspective view of the mating connector yet to be attached to a casing of a power supply circuit.

The housing member 150 has, outside the tube 153, a flange 154 attached to the casing 201 of the power supply circuit 200 (FIGS. 1, 18, and 19). The flange 154 has through holes 154*a* through which male screw members B2 are inserted (FIG. 22) and is fixed to the casing 201 with the male screw members B2 (FIG. 1). The casing 201 has female screw parts N2 into which the male screw members B2 are screwed (FIG. 22).

In the tube 153, the part disposed in the connector insertion direction with respect to the flange 154 (that is, the part protruding from the casing 201) serves as the fitting part (connector fitting part) 153*e* fitted with the connector fitting part 31*a* in the casing 20 of the connector 1 (FIGS. 1, 18, and 19). An annular seal member Se11 is attached to the outer peripheral surface of the connector fitting part 153*e*. The connector fitting part 153*e* is inserted and fitted into the connector fitting part 31*a*. The seal member Se11 is interposed between the connector fitting part 31*a* and the connector fitting part 153*e* and closely in contact with both of their wall surfaces. By contrast, the part of the tube 153 disposed in the connector extraction direction with respect to the flange 154 (that is, the part embedded in the casing 201) serves as a fitting part 153*f* fitted with the holding member 160 (FIGS. 18 and 19).

The holding member 160 is made of an insulating material, such as a synthetic resin. The holding member 160 is fitted with the fitting part 153*f* at the second end opening 153*b* of the tube 153 to cover the insertion ports 153*c* for the mating terminals 110. The fitting part 153*f* is inserted and fitted into the holding member 160. The holding member 160 serves as a fitting part fitted with the casing 201 in the mating connector 101. An annular seal member Se12 is attached to the outer peripheral surface of the holding member 160 (FIGS. 18 and 19).

The mating connector 101 has the structure described above.

Figure 23:
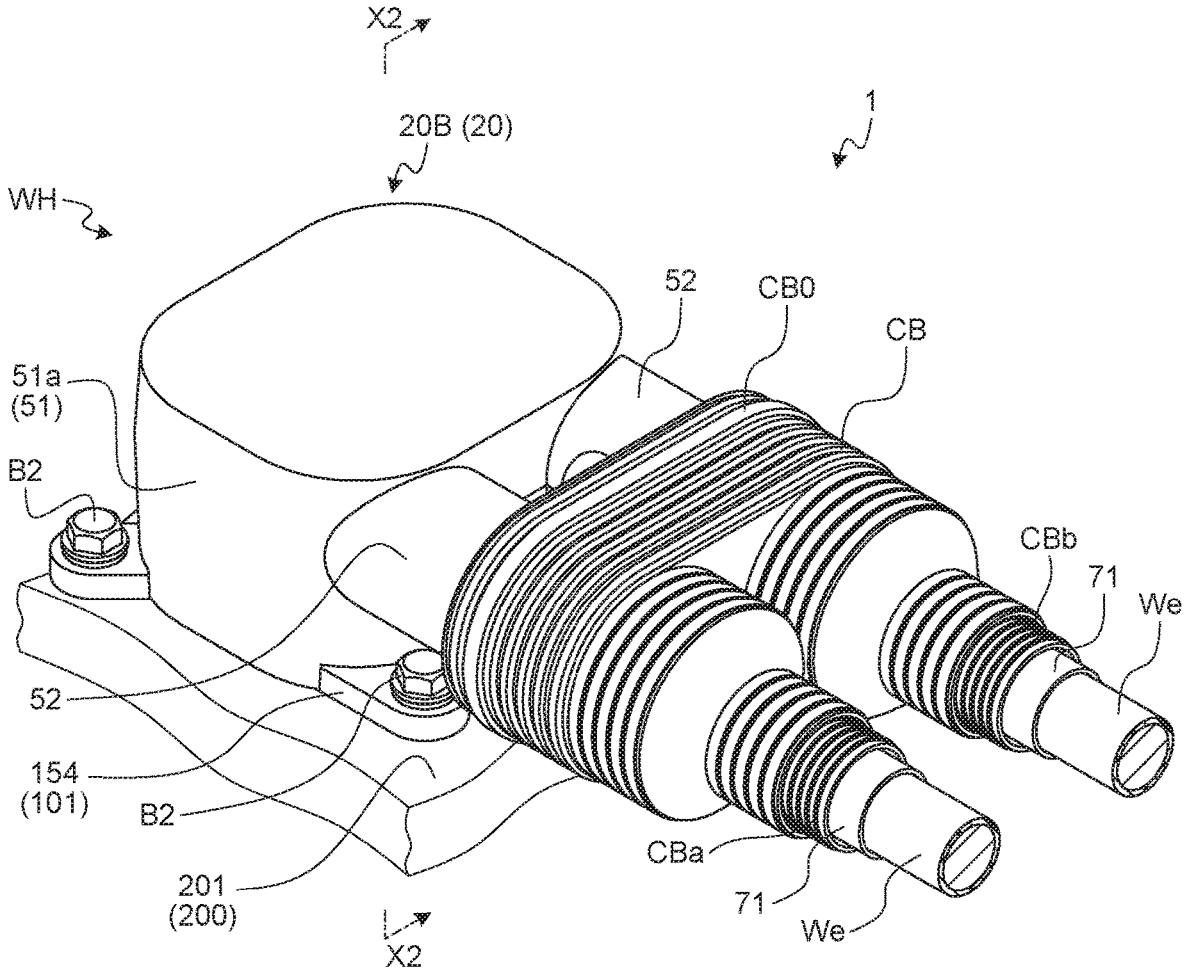
FIG. 23 is a perspective view of the connector and the electric wires with the connector according to the embodiment and the mating connector in a state where the connector is fitted into the mating connector.
Figure 24:
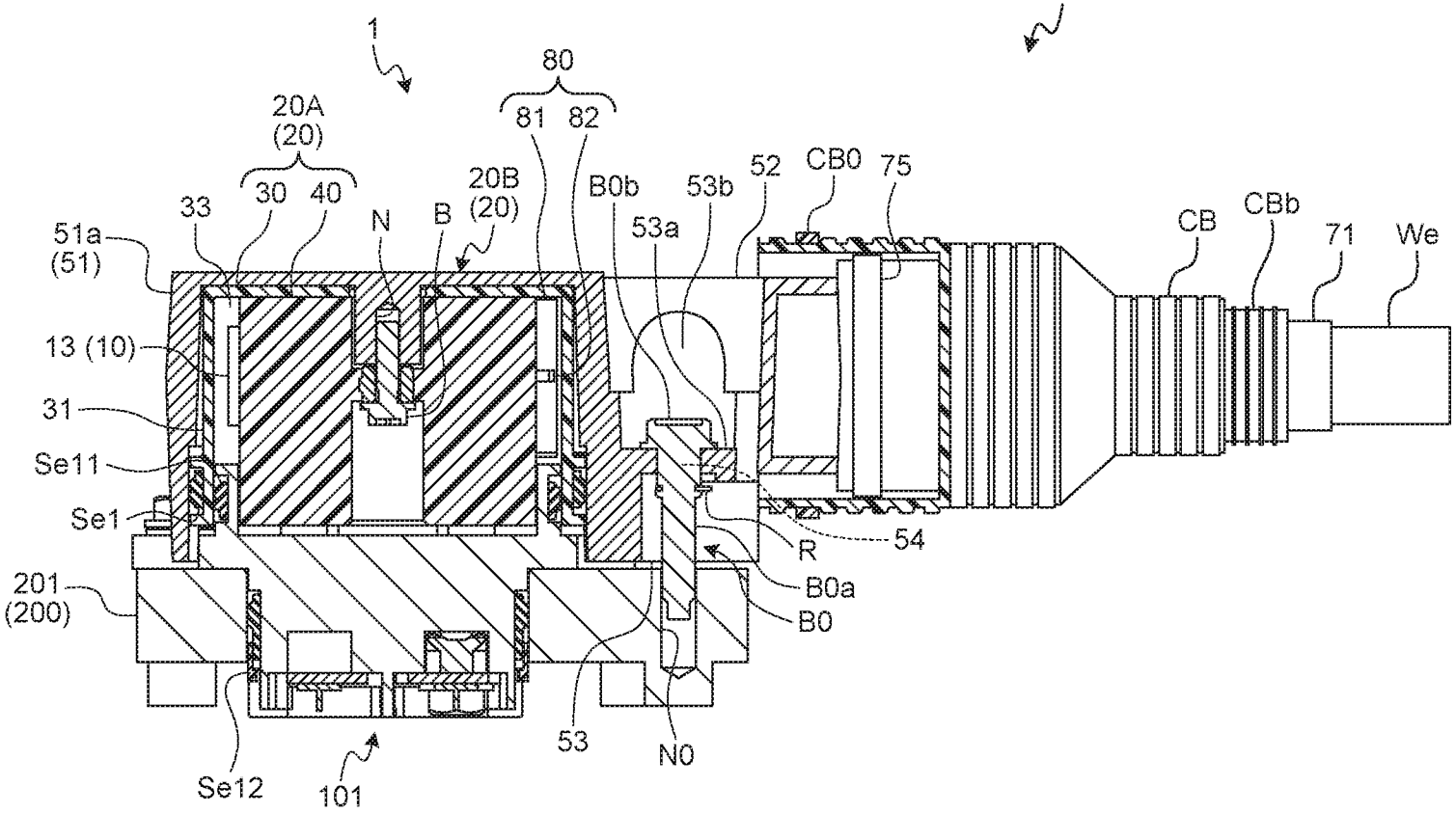
FIG. 24 is a sectional view along line X2-X2 of FIG. 23.

As described above, the connector 1 is inserted and fitted into the mating connector 101, thereby being electrically connected to the mating connector 101 (FIGS. 23 and 24). To maintain the fitted state with the mating connector 101 (that is, the electrical connected state to the mating connector 101), the connector 1 according to the present embodiment is screwed and fixed to the casing 201. In this example, the shield shell 20B is screwed and fixed to the casing 201 made of a conductive material, such as a metal. As a result, the connector 1 is fixed to the casing 201, and the shield shell 20B and the second shield members 71 are electrically connected to the casing 201. The casing 201 is grounded (earthed).

The connector 1 in this example uses the coupler 53 of the shield shell 20B as a holder to fix the shield shell 20B to the casing 201. The shield shell 20B in this example has the coupler 53 between the two sub-shields 52 and is fixed to the casing 201 with the coupler 53.

The coupler 53, for example, has the through hole 54 through which a screw part B0*a* of a male screw member B0 (FIGS. 1 and 24) is inserted (FIGS. 3 and 24). The through hole 54 has its axial direction extending along the tube axial direction of the outer peripheral wall 51*a* of the main shield 51 and is formed in a piece part 53*a* of the coupler 53 (FIG. 24). The wall surface of the piece part 53*a* serves as a bearing surface of a head B0*b* of the male screw member B0. In this example, a locking member R, such as a C-shaped ring, is attached to the screw part B0*a* of the male screw member B0 in a manner sandwiching the piece part 53*a* between the locking member R and the head B0*b* (FIGS. 1 and 24). By sandwiching the piece part 53*a* between the head B0*b* and the locking member R, the male screw member B0 is attached to the coupler 53 in a manner rotatable about the axis. The casing 201 has a female screw part N0 (FIGS. 1, 22, and 24). In this example, the male screw member B0 is screwed into the female screw part N0 when fitting of the connector 1 with the mating connector 101 is finished. With this structure, the connector 1 can maintain the fitted state with the mating connector 101 (electrical connected state to the mating connector 101). The coupler 53 has a working space 53*b* for attaching a tool, such as a socket, to the head B0*b* and rotating the head B0*b* about the axis with the tool (FIG. 24).

The connector 1 according to the present embodiment includes the insulating tube 80 that covers the electric wire connecting part 12 and the terminal of the electric wire We from outside in the sub-shield 52. Consequently, the connector 1 can secure a desired insulation distance between the electric wire connecting part 12 and the sub-shield 52.

In the conventional connector, the electric wire connecting part and the terminal of the electric wire are also accommodated in the insulating housing, and the housing is covered with the shield shell. In other words, in the conventional connector, a tube corresponding to the insulating tube 80 according to the present embodiment is integrated with the first housing member 30, and the housing including the first housing member 30 is covered with the main shield 51 of the shield shell 20B. With this structure, the housing of the conventional connector has a larger size, and the shield shell that covers the housing also has a larger size, whereby the whole connector has a larger size. By contrast, in the connector 1 according to the present embodiment, the first housing member 30 and the insulating tube 80 are provided as different parts. With this structure, the housing 20A and the main shield 51 can be downsized, whereby the whole connector 1 can be downsized. In the connector 1, the second housing member 40 has a function of suppressing positional deviation of the insulating tube 80. Consequently, the connector 1 according to the present embodiment can be downsized and implement a function of preventing contact of fingers with the electrical connecting part 11, a function of preventing coming-off of the electrical connecting part 11 from the terminal housing chamber 41, and a function of suppressing positional deviation of the insulating tube 80.

Instead of the insulating tube 80, the connector 1 can increase the insulation distance between the electric wire connecting part 12 and the sub-shield 52 with an insulating tape or a heat-shrinkable tube like in the conventional technique. However, the position and the shape of the wounded insulating tape vary unless the position and the number of winding around the electric wire connecting part 12 or the like are strictly controlled. Similarly, the position and the shape of the shrunk heat-shrinkable tube vary unless the position where the tube is shrunk or the like is strictly controlled. As described above, it is difficult for the insulating tape and the heat-shrinkable tube to secure a stable quality. By contrast, the insulating tube 80 can be produced by die machining, cutting, or other processing and suppress positional deviation with respect to the housing 20A. The use of the insulating tube 80 can reduce variations in the position and the shape after being attached. Consequently, the connector 1 according to the present embodiment can secure a more stable quality than in the conventional technique.

Furthermore, the connector 1 according to the present embodiment can be extracted from the mating connector 101 by releasing the screwed state between the male screw member B0 and the female screw part N0. By extracting the connector 1 from the mating connector 101, the terminal insertion port 43 for the mating terminal 110 is exposed. The connector 1 includes the contact prevention part 45 to prevent fingers of an operator and other persons from reaching the electrical connecting part 11 of the terminal fitting 10 through the terminal insertion port 43. Consequently, the connector 1 can prevent contact of fingers with the electrical connecting part 11. In the connector 1, the plate-like contact prevention part 45 having two flat wall surfaces is formed in the communication chamber 44 with the two wall surfaces extending along the tube axial direction of the outer peripheral wall 31. With this structure, the contact prevention part 45 has high rigidity in the tube axial direction and is hard to significantly deform when receiving a load from fingers in the tube axial direction. Consequently, the connector 1 can increase the advantageous effect of preventing contact of fingers with the electrical connecting part 11. To use the connector 1 in a higher-current system, the terminal fitting 10 and the mating terminal 110 need to have a larger size. As a result, the casing 20 has a larger size, whereby the terminal insertion port 43 is expanded. Even in this case, the connector 1 according to the present embodiment can prevent contact of fingers with the electrical connecting part 11.

In the connector 1, the second housing member 40 has a function of preventing contact of fingers with the electrical connecting part 11 by the contact prevention part 45 and a function of preventing coming-off of the electrical connecting part 11 from the terminal housing chamber 41 by the terminal holding part 46. As a result, the connector 1 according to the present embodiment does not require any dedicated parts for the functions described above and requires a smaller number of parts. Consequently, the connector 1 can implement the function of preventing contact of fingers with the electrical connecting part 11 and the function of preventing coming-off of the electrical connecting part 11 from the terminal housing chamber 41 at a lower cost.

The connector 1 according to the present embodiment includes the combinations of the terminal fitting 10, the electric wire We, the terminal housing chamber 41, the cutout 42, the terminal insertion port 43, the communication chamber 44, the contact prevention part 45, the terminal holding part 46, the sub-shield 52, the holding member 20C, the second shield member 71, and the insulating tube 80 corresponding to the number of poles. In other words, the connector 1 simply requires the combinations corresponding to the number of poles. Consequently, the connector 1 can be designed corresponding to a larger number of poles in a simpler manner.

The various advantageous effects described above can be similarly provided by the electric wire WH with the connector including the connector 1.

A connector and an electric wire with the connector according to the present embodiments include an insulating tube that covers an electric wire connecting part and a terminal of the electric wire from outside in a sub-shield. Consequently, the connector and the electric wire with the connector can secure a desired insulation distance between the electric wire connecting part and the sub-shield.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal fitting including an electrical connecting part that is electrically connected to a mating terminal of a mating connector and an electric wire connecting part that is electrically connected to a terminal of an electric wire;

an insulating housing that accommodates the electrical connecting part in an inward accommodation space and causes the electric wire connecting part to protrude outward; and a conductive shield shell that accommodates a space from the housing to the terminal of the electric wire inward and covers the space from outside, wherein the shield shell includes a main shield that covers the housing from outside and a tubular sub-shield that covers the electric wire connecting part and the terminal of the electric wire from outside and is provided for the terminal fitting, an insulating tubular member that covers the electric wire connecting part and the terminal of the electric wire from outside is provided inward in the sub-shield, and the insulating tubular member is a separate part from the insulating housing.

2. The connector according to claim 1, wherein the housing has an insertion hole through which the terminal fitting is inserted into the accommodation space from a distal end on a side of the electrical connecting part together with a first end of the tubular member in a first tube axial direction of the tubular member.

3. The connector according to claim 2, wherein the housing includes a first housing member that has a tubular shape with an opening at at least one end in a second tube axial direction and that accommodates the electrical connecting part in the inward accommodation space and a second housing member that is accommodated in the accommodation space along the second tube axial direction from the opening of the first housing member, an outer peripheral wall of the first housing member has the insertion hole, and the second housing member has a terminal housing chamber that accommodates the electrical connecting part in the accommodation space, a terminal holding part that holds a held part of the terminal fitting so as to prevent the electrical connecting part from coming off the terminal housing chamber, and a locking part that locks a locked part provided at the first end of the tubular member in the first tube axial direction of the tubular member to prevent a movement of the tubular member with respect to the housing in the first tube axial direction of the tubular member.

4. The connector according to claim 3, wherein a second shield member that is electrically connected to the shield shell serving as a first shield member is provided for each of the terminal fitting, and the second shield member has a tubular shape so as to cover, from outside, an end of the sub-shield on a side of an opening and the electric wire led out from the opening of the sub-shield.

5. The connector according to claim 2, wherein a second shield member that is electrically connected to the shield shell serving as a first shield member is provided for the terminal fitting, and the second shield member has a tubular shape so as to cover, from outside, an end of the sub-shield on a side of an opening and the electric wire led out from the opening of the sub-shield.

6. The connector according to claim 1, wherein a second shield member that is electrically connected to the shield shell serving as a first shield member is provided for the terminal fitting, and the second shield member has a tubular shape so as to cover, from outside, an end of the sub-shield on a side of an opening and the electric wire led out from the opening of the sub-shield.

7. An electric wire with a connector comprising:

an electric wire;

a terminal fitting including an electrical connecting part that is electrically connected to a mating terminal of a mating connector and an electric wire connecting part that is electrically connected to a terminal of the electric wire;

an insulating housing that accommodates the electrical connecting part in an inward accommodation space and causes the electric wire connecting part to protrude outward; and a conductive shield shell that accommodates a space from the housing to the terminal of the electric wire inward and covers the space from outside, wherein the shield shell includes a main shield that covers the housing from outside and a tubular sub-shield that covers the electric wire connecting part and the terminal of the electric wire from outside and is provided for the terminal fitting, an insulating tubular member that covers the electric wire connecting part and the terminal of the electric wire from outside is provided inward in the sub-shield, and the insulating tubular member is a separate part from the insulating housing.

* * * * *